US010871269B2

(12) United States Patent
Li

(10) Patent No.: US 10,871,269 B2
(45) Date of Patent: Dec. 22, 2020

(54) LIGHTING EQUIPMENT

(71) Applicants: HANGZHOU GREAT STAR INDUSTRIAL CO., LTD., Hangzhou (CN); HANGZHOU GREAT STAR TOOLS CO., LTD., Hangzhou (CN)

(72) Inventor: Yueming Li, Hangzhou (CN)

(73) Assignees: HANGZHOU GREAT STAR INDUSTRIAL CO., LTD., Hangzhou (CN); HANGZHOU GREAT STAR TOOLS CO., LTD., Hangzhou (CN)

( * ) Notice: Subject to any disclaimer, the term of this patent is extended or adjusted under 35 U.S.C. 154(b) by 0 days.

(21) Appl. No.: 16/614,103

(22) PCT Filed: May 15, 2017

(86) PCT No.: PCT/CN2017/084371
§ 371 (c)(1),
(2) Date: Nov. 15, 2019

(87) PCT Pub. No.: WO2018/209512
PCT Pub. Date: Nov. 22, 2018

(65) Prior Publication Data

US 2020/0173629 A1 Jun. 4, 2020

(51) Int. Cl.
*F21V 7/00* (2006.01)
*F21V 29/505* (2015.01)
(Continued)

(52) U.S. Cl.
CPC ..... *F21V 7/0075* (2013.01); *F21L 4/085* (2013.01); *F21V 5/005* (2013.01);
(Continued)

(58) Field of Classification Search
CPC ..... F21V 7/0075; F21V 29/505; F21V 5/005; F21V 23/0421; F21L 4/085
See application file for complete search history.

(56) References Cited

U.S. PATENT DOCUMENTS 4,733,337 A * 3/1988 Bieberstein ..... F21L 2/00 362/157
4,788,633 A * 11/1988 Zimermann ..... F21V 7/0075 362/188
(Continued)

FOREIGN PATENT DOCUMENTS

CN 202338784 U 7/2012
CN 202484612 U 10/2012
(Continued)

OTHER PUBLICATIONS

PCT; App No. PCT/CN2017/084371; International Search Report and Written Opinion dated Feb. 26, 2018.

*Primary Examiner* — Ismael Negron
*Assistant Examiner* — Christopher E Dunay
(74) *Attorney, Agent, or Firm* — Fitch, Even, Tabin & Flannery LLP

(57) ABSTRACT

The present invention provides a lighting equipment, which successively includes a lamp head portion, a connecting portion and a tail portion; the lighting equipment further includes a short distance light source, a long distance light source, a power supply and a control switch. The short distance light source and the long distance light source are arranged inside the lamp head portion, and the light emitting direction of the short distance light source is consistent with that of the long distance light source. The power supply is provided inside the connecting portion, a positive electrode and a negative electrode of which are electrically connected to two ends of the short distance light source and two ends of the long distance light source respectively. The control switch is used for controlling a light and shade state of the short distance light source and the long distance light source.

11 Claims, 21 Drawing Sheets

(51) Int. Cl.

| | |
|---|---|
| ***F21L 4/08*** | (2006.01) |
| ***F21V 5/00*** | (2018.01) |
| ***F21V 23/04*** | (2006.01) |
| *F21Y 115/10* | (2016.01) |

(52) U.S. Cl.
CPC ..... *F21V 23/0421* (2013.01); *F21V 29/505* (2015.01); *F21Y 2115/10* (2016.08)

(56) References Cited

U.S. PATENT DOCUMENTS

2005/0174772 A1* 8/2005 Gun ..... F21V 7/0075 362/247
2005/0201100 A1* 9/2005 Cassarly ..... G02B 19/0028 362/317
2006/0056176 A1* 3/2006 Au ..... F21L 4/005 362/188
2007/0236920 A1* 10/2007 Snyder ..... F21V 29/89 362/157
2010/0091485 A1* 4/2010 Matthews ..... F21V 23/0414 362/234
2011/0012534 A1* 1/2011 West ..... F21V 23/0492 315/307
2013/0155666 A1* 6/2013 Yeh ..... F21V 14/065 362/187
2016/0153646 A1* 6/2016 Maglica ..... F21V 7/0075 362/187

FOREIGN PATENT DOCUMENTS

CN 103363475 A 10/2013
CN 103884002 A 6/2014
CN 105570716 A 5/2016

* cited by examiner

LIGHTING EQUIPMENT

CROSS-REFERENCE TO RELATED APPLICATIONS

This application is a U.S. national phase application of International Application No. PCT/CN2017/084371, filed May 15, 2017, designating the United States.

FIELD OF THE INVENTION

The present invention relates to the field of lighting equipment, and in particular to a lighting equipment.

DESCRIPTION OF THE PRIOR ART

Traditional lighting equipment, such as a flashlight and a searchlight, usually use LED lights as the light source inside their lamp heads, can only perform simple illumination, and are prone to cause dizziness and discomfort to a person after looking at the LED light sources for a long period, or even damage the eyes.

Generally, prior lighting equipments are only provided with an LED light source, the long and short distance light adjustment of which is usually implemented by adjusting the distance between a lamp bead and a reflective surface to achieve the convergence and divergence effects of the light source. The most common way to adjust the distance between the lamp bead and an outermost lampshade is by drawing or rotating a head portion of the flashlight, thereby adjusting the convergence and divergence effects of a light beam. When these two ways are adopted to adjust the light beam of the flashlight, the user often needs to use two hands to operate, which is inconvenient. In addition, since the head portion of the flashlight is designed to be a drawable or rotatable shape, there is some gap at a joint between the head portion and an outer casing, inevitably, and the size of such gap is difficult to be controlled factitiously. In case of long-term use, the gap at the joint between the head portion of the flashlight and the outer casing gradually increases, thereby causing undesirable practical water-proof effects of the flashlight.

A handheld lighting device, which can adjust the long and short distance light effects by using a single hand, is commercially desirable in that the operation is simpler and more convenient.

SUMMARY OF THE INVENTION

An object of the present invention is to provide lighting equipment so as to solve the technical problems existing in the prior art, such as the necessity of using two hands to adjust the long and short distance light, poor water-proof effects and the bad heat dissipation performance.

In order to solve the above technical problems, the present invention provides lighting equipment, successively including a lamp head portion, a connecting portion and a tail portion; further including a short distance light source, a long distance light source, a power supply and a control switch. The short distance light source and the long distance light source are arranged inside the lamp head portion, and the light emitting direction of the short distance light source is consistent with that of the short distance light source. The power supply is provided inside the connecting portion, a positive electrode and a negative electrode of which are electrically connected to two ends of the short distance light source and two ends of the long distance light source respectively. The control switch is provided at a surface of the connecting portion and/or the tail portion, for controlling a light and shade state of the short distance light source and/or the long distance light source respectively.

Further, in different embodiments, the lamp head portion includes a reflective member which includes a reflective member main plate, a tapered reflective surface and a reflective member through hole, which are integrated. The tapered reflective surface protrudes from a middle portion of a surface at one side of the reflective member main plate, including a large open end and a small open end, and the large open end arranged in the middle of the reflective plate main plate. The reflective member through hole penetrates through the reflective member main plate; the short distance light source is a COB lamp plate, mounted to the reflective member main plate, and arranged around the large open end of the tapered reflective surface.

Further, in different embodiments, the reflective member further includes a heat fin and/or a heat sink and a heat dissipation channel. The heat fin protrudes from an outside wall of the tapered reflective surface; the heat sink protrudes from the surface of the reflective member main plate. The heat dissipation channel is enclosed by the heat fin and/or the heat sink and is communicated to the reflective member through hole; the reflective member is made from a metal material.

Further, in different embodiments, the COB lamp plate includes a COB substrate, and further includes one COB chip which is annular and is fitted onto the COB substrate; or, more than two COB chips, which are strip-shaped, forming an annular shape and mounted onto the COB substrate.

Further, in different embodiments, an edge of the reflective member main plate is provided with a protruding reflective member inclosing plate; an inside wall of the reflective member inclosing plate is provided with at least one reflective member snap latch; the edge of the COB substrate is engaged to the reflective member snap latch.

Further, in different embodiments, the reflective member inclosing plate is provided with at least one inclosing plate notch, corresponding to the reflective member through hole; the edge of the COB substrate is provided with at least one protruding COB wiring board, snapped into the inclosing plate notch.

Further, in different embodiments, the lamp head portion includes a lamp bead base fixedly connected to the reflective member; the lamp bead base includes a lamp bead base partition plate provided with at least one partition plate through hole.

Further, in different embodiments, the lamp bead base further includes a first hollow cavity of the lamp bead base and a second hollow cavity of the lamp bead base; the first hollow cavity of the lamp bead base and the second hollow cavity of the lamp bead base are provided at the two sides of the lamp bead base partition plate respectively; one part of the reflective member is inserted to the first hollow cavity of the lamp bead base.

Further, in different embodiments, the lamp bead base further includes a lamp bead mounting slot and a second hollow cavity of the lamp bead base; the lamp bead mounting slot and the second hollow cavity of the lamp bead base are provided at the two sides of the lamp bead base partition plate respectively.

Further, in different embodiments, the long distance light source is an LED lamp plate on which at least one LED lamp bead is provided; the LED lamp plate is mounted into the first hollow cavity of the lamp bead base or the lamp bead mounting slot; the position of the LED lamp bead corresponds to that of the small open end of the tapered reflective surface; a spacer is provided between the small open end of the tapered reflective surface and the LED lamp plate; the spacer is provided with a spacer light hole and a spacer through hole; the position of the spacer light hole corresponds to that of the LED lamp bead.

Further, in different embodiments, the lamp head portion includes a light source circuit board which is provided with a switch control circuit, the short distance light source and the long distance light source are electrically connected to the power supply through the switch control circuit; the switch control circuit includes a touch switch and a controller; the controller controls the light and shade state of the short distance light source and/or the long distance light source according to the number of times of on and off of the touch switch.

Further, in different embodiments, the lamp head portion includes a lamp head inner casing, including opposing inner casing light exit port and an inner casing opening; a light transmitting member, mounted to the inner casing light exit port; and a first sealing member, arranged at the joint of the inner casing light exit port and the light transmitting member.

Further, in different embodiments, the lamp head portion further includes a lamp head outer casing, including an outer casing light exit port corresponding to the inner casing light exit port; and an outer casing opening, sheathing the lamp head inner casing, opposite the outer casing light exit port.

Further, in different embodiments, the lamp head portion includes a lamp head base mounted to the inner casing opening of the lamp head inner casing; the lamp head base is provided with a lamp head base hollow cavity in the middle, one part of the lamp bead base is inserted to the lamp head base hollow cavity; and a second sealing member, arranged at the joint between the lamp head base and the inner casing opening.

Further, in different embodiments, the lamp head portion includes a first conductive member fixing base, a first conductive member and a first spring. The first conductive member fixing base is arranged in the lamp head base hollow cavity, including a first fixing base body and a first connecting pipe, which are integrated. The first fixing base body is provided with a first fixing base through hole in the middle; the first connecting pipe is connected to the lamp bead base; one end of the first conductive member passes through the first fixing base through hole and is electrically connected to a first contact of a battery holder; the other end thereof is provided with a first conductive member recess; one end of the first spring is provided inside the first conductive member recess, and the other end thereof is electrically connected to one conductor slice of the light source circuit board.

Further, in different embodiments, the lamp head portion includes a second conductive member fixing base, a second conductive member gasket and a second conductive member. The second conductive member fixing base is arranged inside the lamp head base hollow cavity, including a second fixing plate and a second connecting pipe, which are integrated, and the second fixing plate is provided with a second fixing plate through hole in the middle and is fixedly connected to the battery holder; the second connecting pipe protrudes from the surface of the second fixing base plate, the position of which corresponds to the second fixing plate through hole. The second conductive member gasket is arranged between the second fixing plate and the light source circuit board; one end of the second conductive member is electrically connected to one conductor slice of the light source circuit board, the other end thereof passes through the second connecting pipe and the second conductive member gasket and is electrically connected to the power supply.

Further, in different embodiments, the lamp head portion includes a light source bracket, for mounting the short distance light source and the long distance light source; the short distance light source and the long distance light source are located on the same plane.

Further, in different embodiments, the lamp head portion includes a tapered lens, a lens bracket and an annular cover plate. The two ends of the tapered lens are a large lens face and a small lens face respectively, the small lens face provided with a lens recess in the middle; the lens bracket is fixed to the light source bracket in which the tapered lens is mounted, the shape of which corresponds to that of the tapered lens; the annular cover plate is fixed to the lens bracket, and is located on the same plane as the large lens face; the long distance light source is an LED lamp plate, in the middle of which at least one LED lamp bead is provided, protruding into the lens recess.

Further, in different embodiments, the edge of a side wall of the tapered lens is provided with an annular projection, whose position is close to the large lens face; the lens bracket is provided with the annular recess at the inside, corresponding to the annular projection; an inner diameter of the annular cover plate is less than an outer diameter of the annular projection.

Further, in different embodiments, the short distance light source is a COB lamp plate which is annular and surrounds the outside of the LED lamp plate; the COB lamp plate has a shape of circle, oval, rectangle or rounded rectangle.

Further, in different embodiments, the short distance light source is at least one COB substrate, which is strip-shaped and is arranged next to the LED lamp plate.

Further, in different embodiments, the lens bracket is provided therein with an annular hollow cavity, which surrounds the outside of the tapered lens and corresponds to the COB lamp plate.

Further, in different embodiments, the connecting portion includes a tube body, a third sealing member, a battery holder and at least one battery. One end of the tube body is connected to the lamp head base, and the other end thereof is connected to a tail hood inner casing; the third sealing member is arranged at the joint between the tube body and the lamp head base; the battery holder is arranged inside the tube body, whose two ends are provided with a first contact and a second contact; the battery is arranged inside the battery holder; when the number of the batteries is more than two, the batteries are connected in series with each other.

Further, in different embodiments, the tail portion includes a tail hood inner casing and a fourth sealing member, one end of the tail hood inner casing is inserted to the tube body, the other end thereof is provided with an inner casing switch through hole; the fourth sealing member is arranged at the joint between the tail hood inner casing and the tube body.

Further, in different embodiments, the tail portion includes a tail hood outer casing, one end of which sheathes the tail hood inner casing, and the other end of which is provided with an outer casing switch through hole.

Further, in different embodiments, the tail hood inner casing is provided with a push switch therein, including a pressing end and two pins; a switch circuit board, including two insulated conductor slices which are electrically connected to the two pins of the push switch respectively; and a tail hood conductive member, one end of which is electrically connected to the second contact of the battery holder, and the other end of which is electrically connected to the switch circuit board.

The present invention has the advantages that the lighting equipment provided herein is provided with both the LED light source and the COB light source, so the user can flexibly control the two groups of light sources simply by using a single hand, which is simple in operation and convenient in use. The present invention has good circuit stability and low fault rate. The present invention has good water-proof performance, can be used for wet environments and is easy to market application. In addition, the present invention is provided with two groups of adjacent light sources at the same time which give out heat simultaneously. The present invention has good heat dissipation performance, can rapidly and effectively radiate heat, and prevents parts from being malfunctioned.

Figure 1:
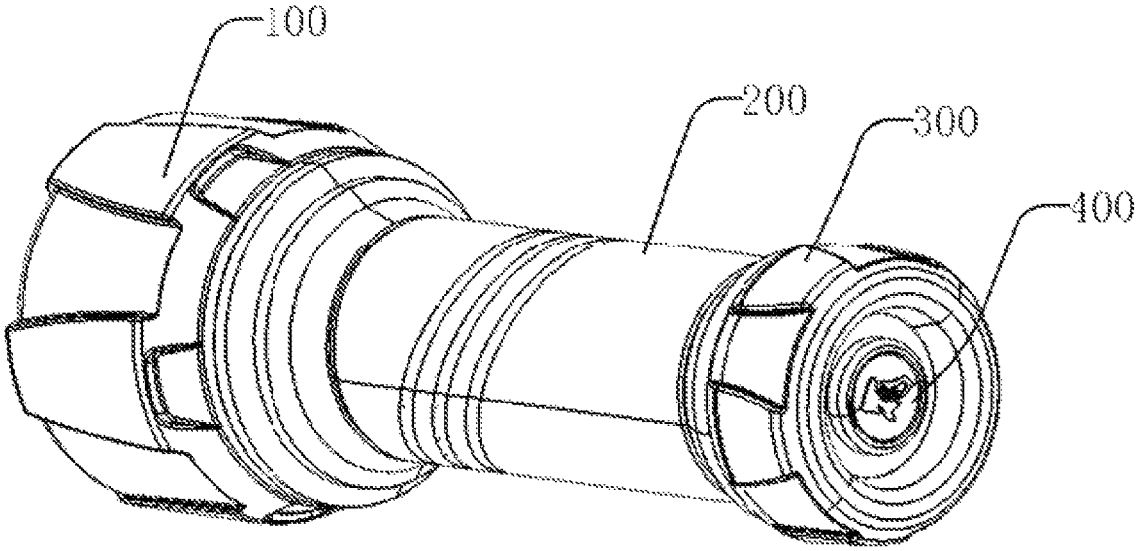
FIG. 1 is a schematic view of an overall structure according to the first embodiment of the present invention.

Reference numerals of the components of the figures are as follows:

100 lamp head portion, 200 connecting portion, 300 tail portion, 400 control switch;

101 reflective member, 102 COB lamp plate, 103 lamp bead base, 104 LED lamp plate, 105 light source circuit board,

106 lamp head inner casing, 107 light transmitting member, 108 lamp head outer casing, 109 lamp head base, 110 spacer,

111 first conductive member fixing base, 112 first conductive member, 113 first spring,

114 second conductive member fixing base, 115 second conductive member gasket, 116 second conductive member,

117 light source bracket, 118 tapered lens, 119 lens bracket,

120 annular cover plate, 121 bracket screw, 122 annular hollow cavity;

201 tube body, 202 battery holder; 203 battery;

301 tail hood inner casing, 302 tail hood outer casing, 303 switch cap, 304 switch peg, 305 switch cap lining ring,

306 switch cap clamping ring, 307 push switch, 308 switch circuit board, 309 third conductive member fixing base,

310 third conductive member, 311 third spring, 312 tail hood clamping ring,

313 fourth conductive member, 314 fourth spring, 315 fourth conductive member fixing base;

401 first sealing member, 402 second sealing member, 403 third sealing member, 404 fourth sealing member;

1011 reflective member main plate, 1012 tapered reflective surface, 1013 reflective member through hole, 1014 reflective member inclosing plate,

1015 reflective member snap latch, 1016 inclosing plate notch, 1017 heat fin, 1018 heat sink, 1019 reflective member fixing hole;

1021 COB substrate, 1022 COB chip, 1023 COB wiring board, 1024 COB wiring board;

1031 lamp bead base partition plate, 1032 partition plate through hole, 1033 first hollow cavity of the lamp bead base,

1034 second hollow cavity of the lamp bead base, 1035 lamp bead base fixing hole, 1036 connecting screw rod;

1041 LED lamp bead, 1042 lamp plate through hole;

1051 main loop, 1052 control circuit;

1061 inner casing light exit port, 1062 inner casing opening;

1081 outer casing light exit port, 1082 outer casing opening, 1091 lamp head base hollow cavity;

1111 first fixing base body, 1112 first connecting pipe, 1113 first fixing base through hole;

1121 first conductive member recess; 1141 second fixing plate, 1142 second connecting pipe, 1143 second fixing plate through hole;

1181 large lens face, 1182 small lens face, 1183 lens recess, 1184 annular projection

2021 first contact, 2022 second contact, 3011 inner casing switch through hole, 3021 outer casing switch through hole;

3031 key, 3032 key baffle, 3033 switch cap slot;

3071 pin, 3072 pin, 3073 pressing end;

3091 third fixing base body, 3092 third connecting pipe, 3093 third fixing base through hole;

3101 third conductive member recess, 3131 fourth conductive member recess, 3151 fourth fixing base through hole;

10121 large open end, 10122 small open end.

DETAILED DESCRIPTION OF THE PREFERRED EMBODIMENTS

Preferred embodiments of the present invention will be described more fully hereinafter with reference to the accompanying drawings, in which preferred embodiments of the invention are shown, proving that the present invention can be implemented, for the purpose of clarity and better understanding of the techniques. This invention may be embodied in various different forms and the invention should not be construed as being limited to the embodiments set forth herein.

In the description which follows elements with identical structure are marked with the same reference numerals, and like elements with similar structure or function are marked throughout with like reference numerals, respectively. The dimension and thickness of each element in the accompanying drawings are arbitrarily shown, and the invention does not define the dimension and thickness of each element.

Directional terms described by the present invention, such as upper, lower, front, back, inner, outer, inside, outside, side, top, bottom, top end, bottom end, tail end, clockwise, counter-clockwise, etc., are only directions by referring to the accompanying drawings, and are thus used to describe and understand the present invention, but the present invention is not limited thereto.

It will be understood that when an element is referred to as being "on" another element, it can be directly on the other element, or there may be an intermediate element to which the element is attached, and the intermediate element is attached to the other element. When an element is referred to as being "mounted to" or "connected to" another element, either one can be understood as being directly "mounted" or "connected", or via an intermediate element to be indirectly "mounted to" or "connected to" the other element. When an element is referred to as being "electrically connected to" another member, it is understood that either one is physically connected to another element, and the two elements are both conductors and working current can pass therethrough.

As shown in FIG. 1, the present invention provides lighting equipment, successively including a lamp head portion 100, a connecting portion 200 and a tail portion 300, further including at least one short distance light source, at least one long distance light source, a power supply and a control switch 400. In the present invention, the long distance light source is preferably an LED lamp plate, and the short distance light source is preferably a COB lamp plate. A COB (Chip On Board) light source pertains to a high photosynthetic efficiency integrated surface light source technology in which the LED chip is directly attached on a lens face metal substrate with a high reflective rate. The lamp adopting the COB light source technology has lots of advantages of no strobe, no electromagnetic radiation, low energy consumption, high illuminance and high color rendering index. The COB light source is a new generation light source closest to the natural light and has a remarkable effect on protecting eyes and preventing myopia.

The short distance light source and the long distance light source are arranged inside the lamp head portion 100, and the light emitting direction thereof is consistent with that of the short distance light source. A power supply is provided inside the connecting portion 200; a positive electrode and a negative electrode thereof are electrically connected to two ends of the short distance light source and two ends of the long distance light source respectively. The control switch is provided at a surface of the connecting portion 200 and/or the tail portion 300, for controlling a light and shade state of the short distance light source and/or the long distance light source respectively.

First Embodiment

Figure 2:
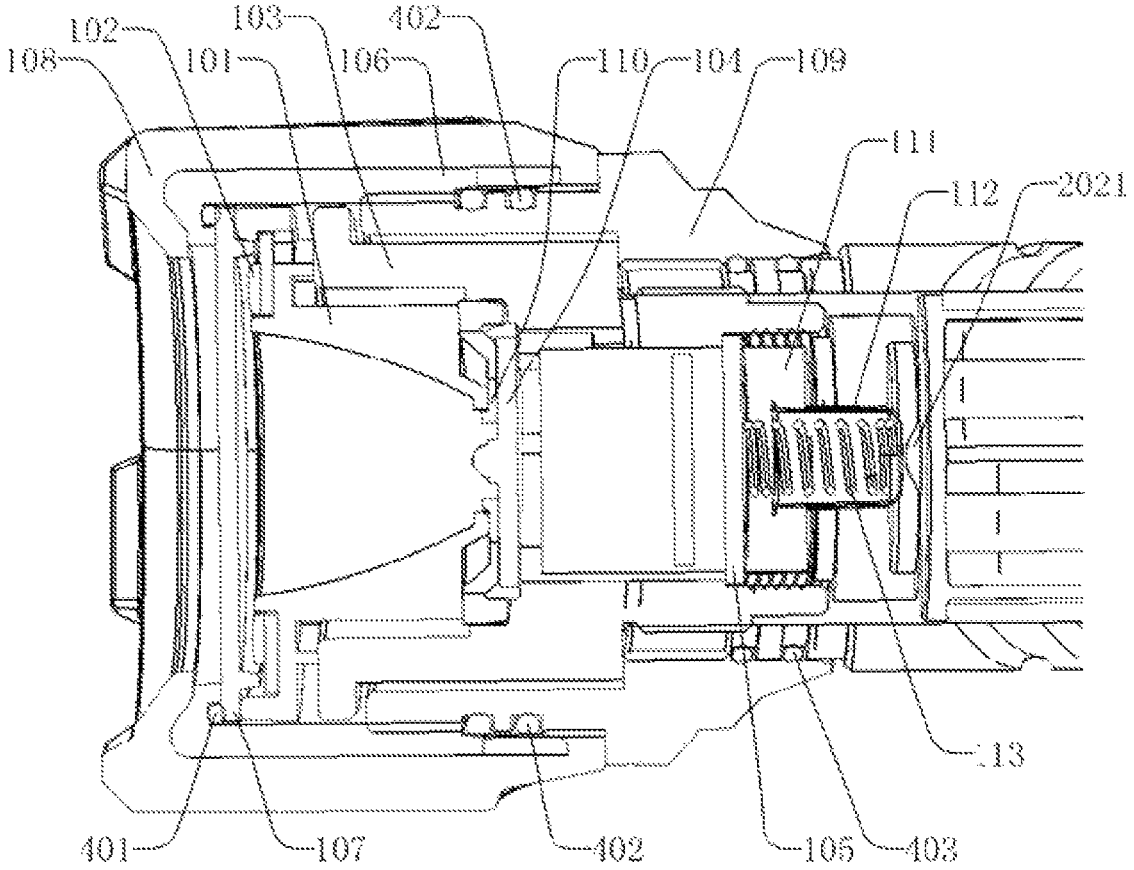
FIG. 2 is a sectional structural schematic view of the lamp head portion in the first embodiment of the present invention.
Figure 3:
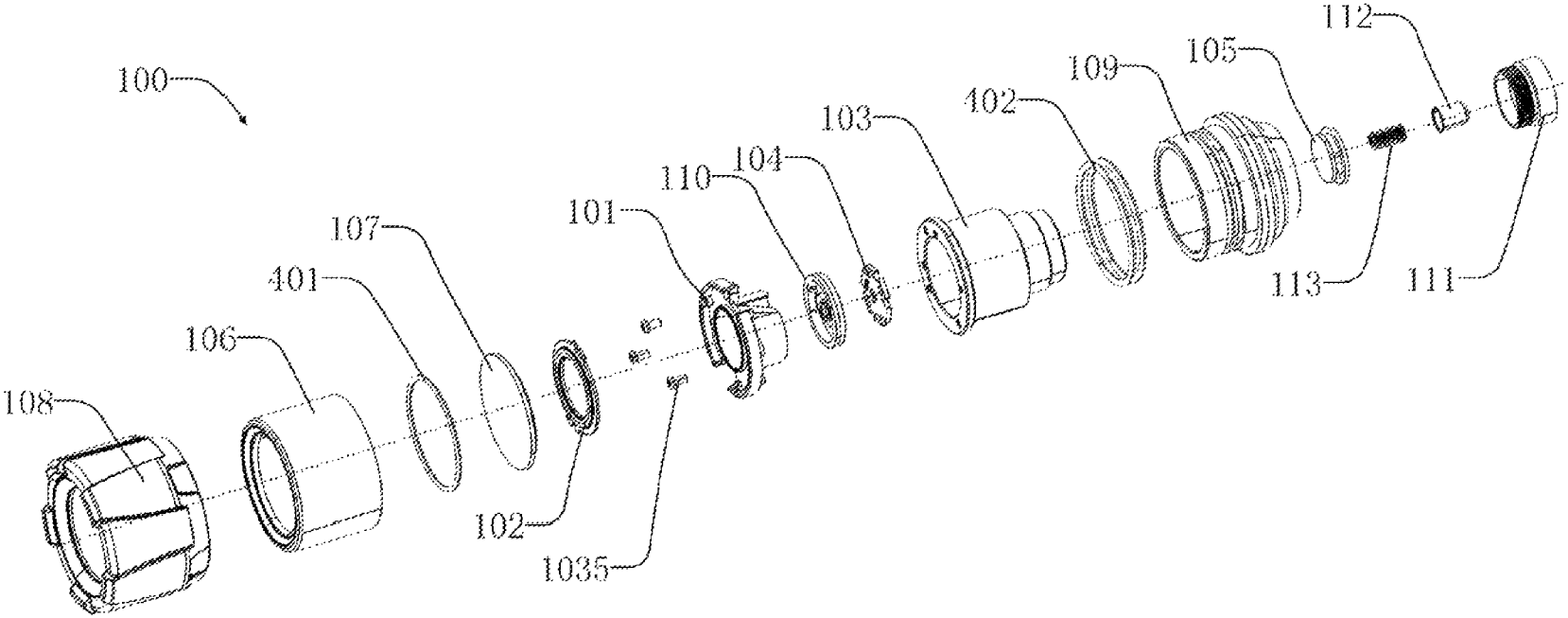
FIG. 3 is an exploded structural schematic view of the lamp head portion in the first embodiment of the present invention.

As shown in FIGS. 2-3, the lamp head portion 100 includes a reflective member 101, a COB lamp plate 102, a lamp bead base 103, an LED lamp plate 104, a light source circuit board 105, a lamp head inner casing 106, a light transmitting member 107, a lamp head outer casing 108 and a lamp head base 109.

Figure 4:
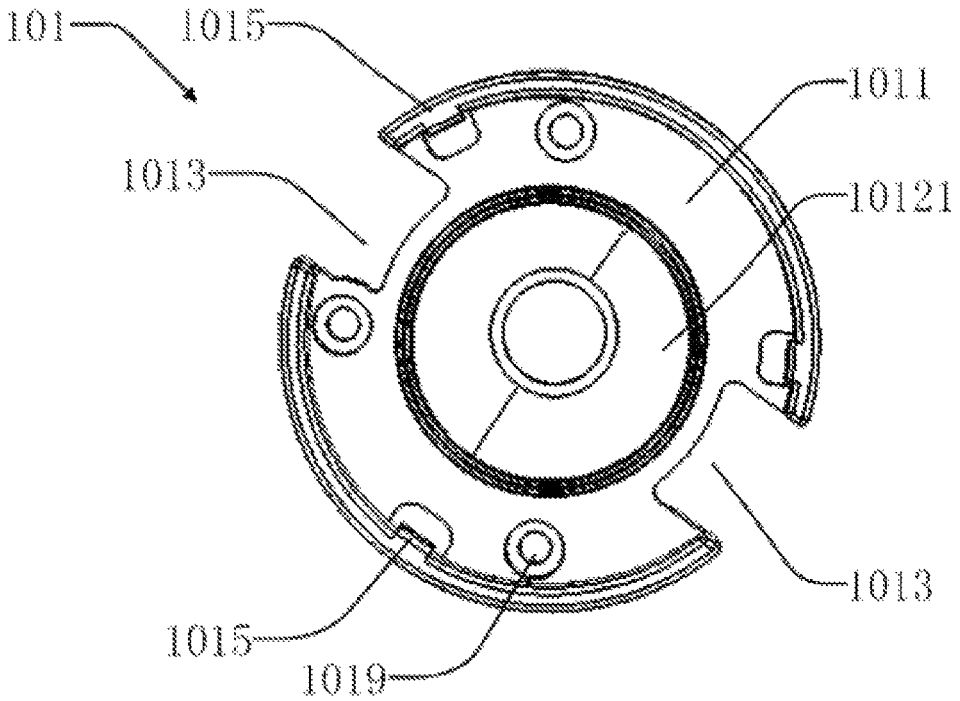
FIG. 4 is a structural schematic view of the front of the reflective member in the first embodiment of the present invention.
Figure 5:
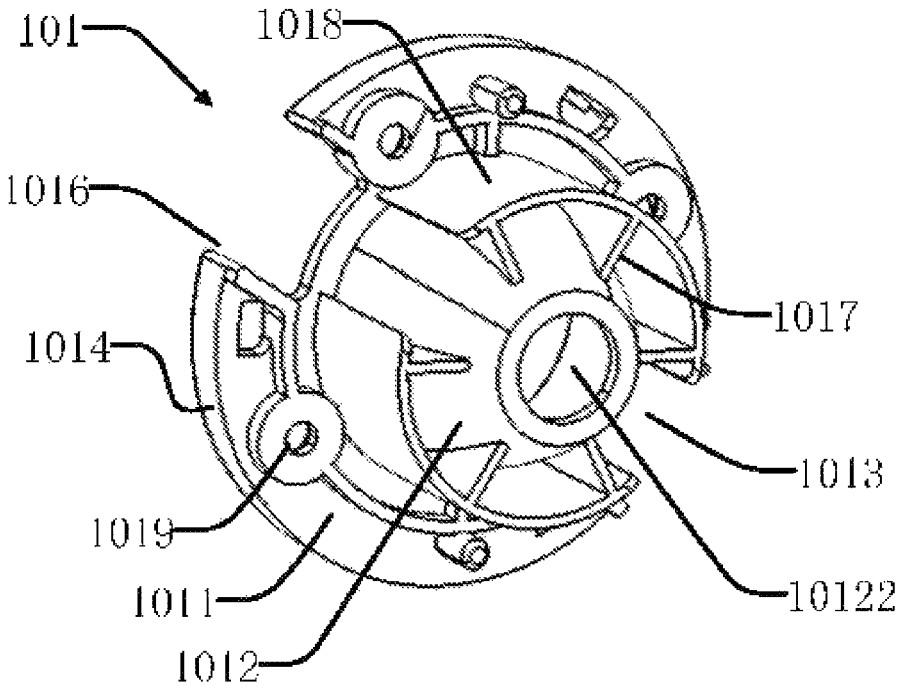
FIG. 5 is a structural schematic view of the back of the reflective member in the first embodiment of the present invention.

As shown in FIGS. 4-5, the reflective member 101 includes a reflective member main plate 1011, a tapered reflective surface 1012 and at least one reflective member through hole 1013, which are integrated. The surface at one side of the reflective member main plate 1011 is provided with a protruding tapered reflective surface 1012 in the middle. The tapered reflective surface 1012 includes a large open end 10121 and a small open end 10122, the large open end 10121 arranged in the middle of the reflective plate main plate 1011. The reflective member through hole 1013 penetrates through the reflective member main plate 1011; various kinds of wires for electrical connection pass through the reflective member through hole 1013.

The edge of the reflective member main plate 1011 is provided with a protruding reflective member inclosing plate 1014 which is perpendicular to the reflective member main plate 1011; the reflective member inclosing plate 1014 and the tapered reflective surface 1012 are located at the two sides of the reflective member main plate 1011 respectively. The inner side wall of the reflective member inclosing plate 1014 is provided with at least one reflective member snap latch 1015, evenly distributed on the inner side wall of the reflective member inclosing plate 1014. Preferably, three reflective member snap latches 1015 are arranged on trisection points of the reflective member inclosing plate 1014. The reflective member inclosing plate 1014 is provided with at least one inclosing plate notch 1016, respectively corresponding to each reflective member through hole 1013. The reflective member snap latch 1015 and the inclosing plate notch 1016 are used for fixing the COB lamp plate 102.

In the present embodiment, the COB lamp plate 102 and the LED lamp plate 104 will dissipate heat during operation. Since the COB lamp plate 102 and the LED lamp plate 104 are adjacent or close to each other in position and will dissipate more heat when operating at the same time, the reflective member 101, as a member directly contacting the COB lamp plate 102 and the LED lamp plate 104, must have good heat dissipating effect.

Each member in the reflective member 101 is designed integrally. The reflective member is made from metal materials, with good heat dissipating performance wholly, so as to dissipate the heat generated during the operation of the COB lamp plate 102. In order to further improve the heat dissipating effect of the reflective member, the reflective member 101 can further include a heat fin 1017 and a heat sink 1018. The heat fin 1017 protrudes from the outer side wall of the tapered reflective surface 1012; the heat sink 1018 protrudes from the surface of the reflective member main plate 1011 and is connected to the heat fin 1017. The reflective member 101 can be provided with several heat dissipating holes (not shown in the drawing) and can be arranged at any position without affecting the operation of other members. The heat fin 1017, the heat sink 1018 and the heat dissipating holes can effectively increase a surface area of the whole reflective member 101 and increase the heat dissipating efficiency.

In the present embodiment, a plurality of heat dissipation channels (not shown in the drawing) is included. The heat dissipation channel is an unsealed space, can be enclosed by the heat fin 1017 and/or the heat sink 1018, or can be enclosed by the reflective member 101 and the adjacent other members. A relatively large air channel is formed around the tapered reflective surface 1012 and is communicated to the reflective member through hole 1013, such that the air in the rear space of the tapered reflective surface 1012 can be communicated to the outside air, which further enhances the heat dissipating effect.

Figure 6:
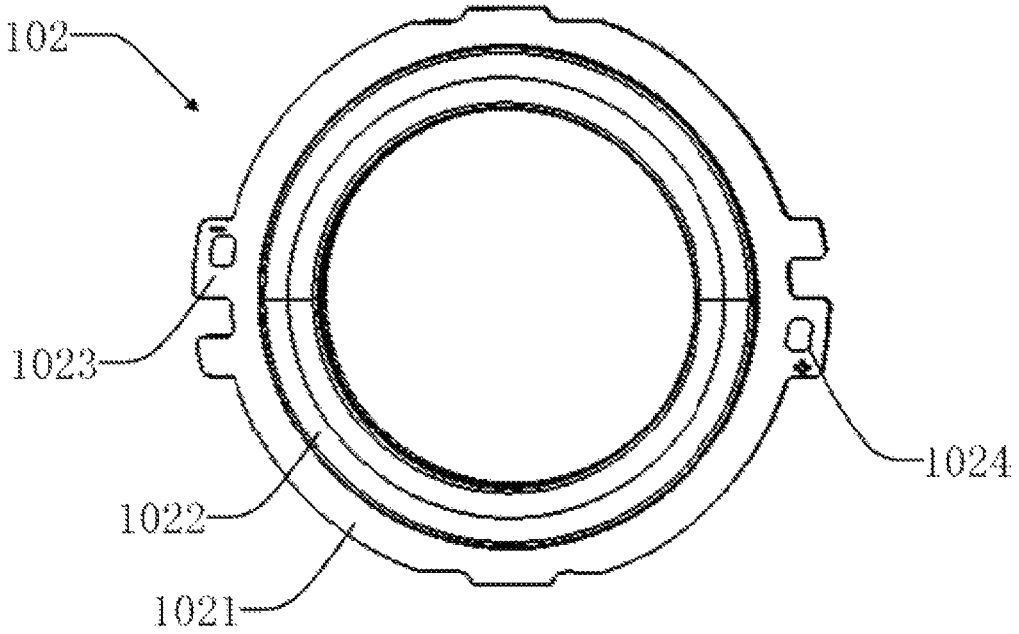
FIG. 6 is a structural schematic view of the COB lamp plate in the first embodiment of the present invention.

As shown in FIG. 6, the COB lamp plate 102 is arranged around the large open end 10121 of the tapered reflective surface 1012. The COB lamp plate 102 includes a COB substrate 1021 and a COB chip 1022. In the present embodiment, the COB chip 1022 is annular and is fitted onto the COB substrate 1021; there can be also a plurality of strip-shaped COB chips 1022 which makes a circle to be mounted onto the COB substrate 1021. The edge of the COB substrate 1021 is provided with two opposing and protruding COB wiring boards 1023, 1024, and is snapped to the inclosing plate notch 1016. Meanwhile, the edge of the COB substrate 1021 is engaged to the reflective member snap latch 1014, such that the COB lamp plate 102 is fixed to the reflective member 101.

Figure 7:
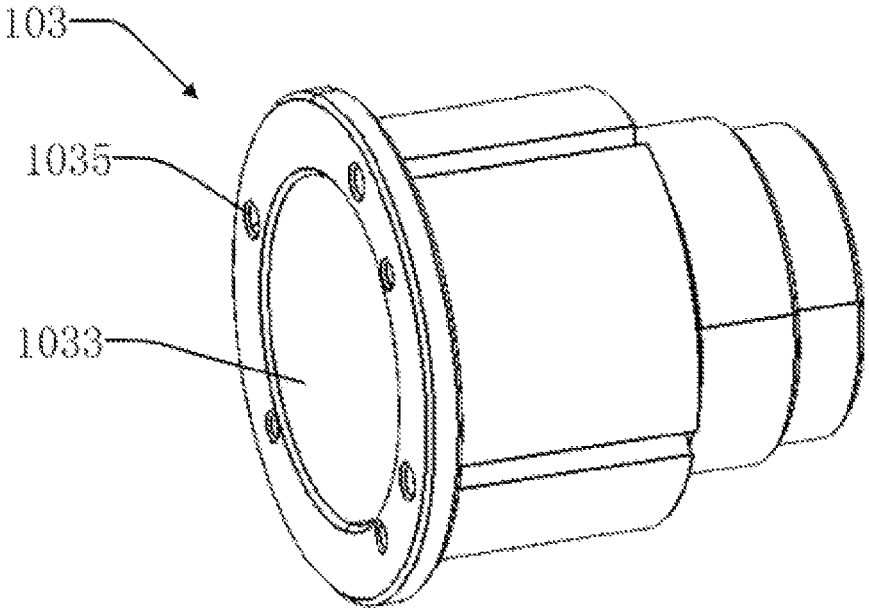
FIG. 7 is a structural schematic view at one side of the lamp bead base in the first embodiment of the present invention.
Figure 8:
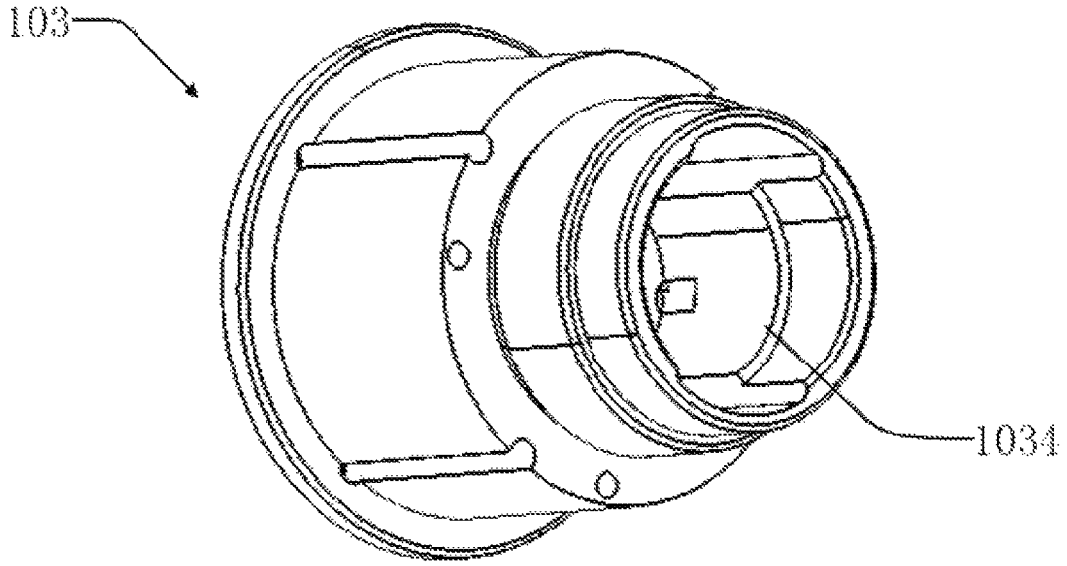
FIG. 8 is a structural schematic view at the other side of the lamp bead base in the first embodiment of the present invention.
Figure 9:
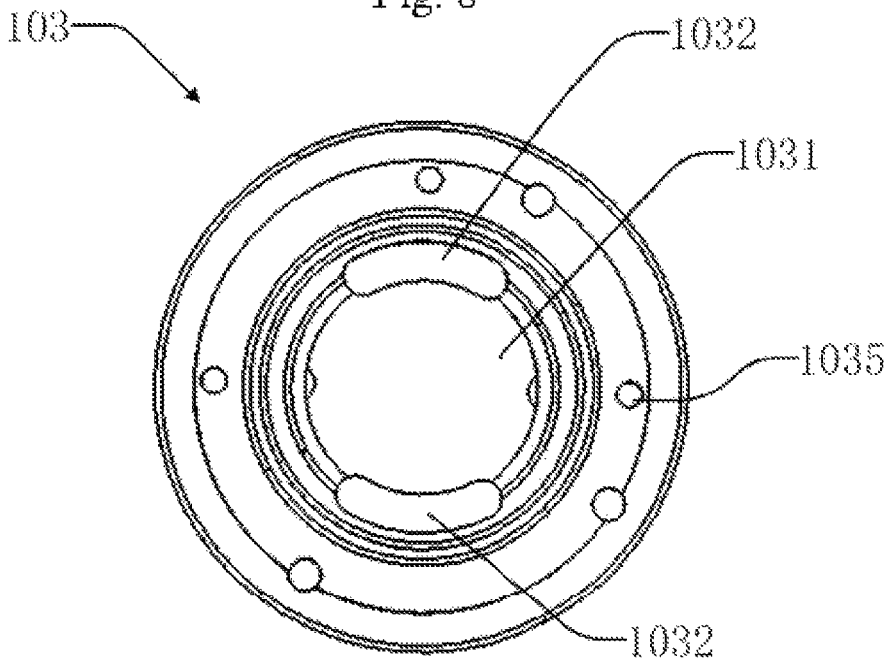
FIG. 9 is a structural schematic view of the front of the lamp bead base in the first embodiment of the present invention.

As shown in FIGS. 7-9, the lamp bead base 103 includes a lamp bead base partition plate 1031 which is provided with at least one partition plate through hole 1032, preferably two or three partition plate through holes. The lamp bead base 103 further includes a first hollow cavity of the lamp bead base 1033 and a second hollow cavity of the lamp bead base 1034, which are arranged at the two sides of the lamp bead base partition plate 1031 respectively; one part of the reflective member 101 mainly includes a small open end 10122 of the tapered reflective surface 1012, inserted to the first hollow cavity of the lamp bead base 1033.

As shown in FIGS. 3-5, 7 and 9, the lamp bead base 103 is fixedly connected to the reflective member 101; the reflective member main plate 1011 is provided with several reflective member fixing holes 1019, the lamp bead base 103 is also provided with several lamp bead base fixing holes 1035 at one side toward the reflective member 101. The two groups of fixing holes correspond one to one. A plurality of connecting screw rods 1036 is inserted to the reflective member fixing hole 1019 and the lamp bead base fixing hole 1035 from the direction of the reflective member 101, to fix both the reflective member fixing hole 1019 and the lamp bead base fixing hole 1035 with each other. Preferably, three connecting screw rods are used.

Figure 10:
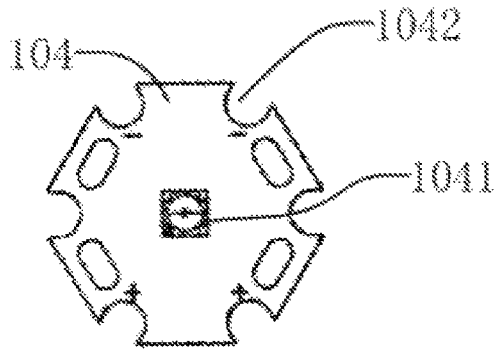
FIG. 10 is a structural schematic view of the LED lamp plate in the first embodiment of the present invention.
Figure 11:
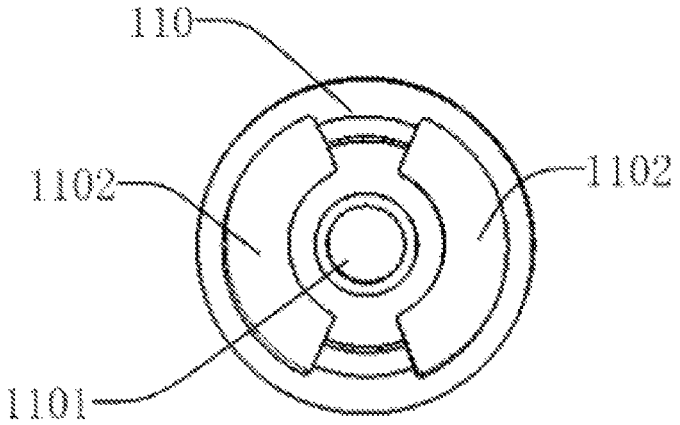
FIG. 11 is a structural schematic view of the spacer in the first embodiment of the present invention.

As shown in FIGS. 10-11, the LED lamp plate 104 is provided with at least one LED lamp bead 1041 thereon; the edge of the LED lamp plate 104 is provided with at least one lamp plate through hole 1042. The LED lamp plate 104 is mounted into the first hollow cavity of the lamp bead base 1033; the LED lamp bead 1041 is dead against the small open end 10122 of the tapered reflective surface 1012; a spacer 110 is arranged between the small open end 10122 and the LED lamp plate 104; the spacer 110 is provided with a spacer light hole 1101 and a spacer through hole 1102; the position of the spacer light hole 1101 corresponds to that of the LED lamp bead 104. Various kinds of wires can pass through the LED lamp plate 104 from the lamp plate through hole 1042 and can pass through the spacer 110 from the spacer through hole 1102.

The power supply circuit board 105 is fixed inside the lamp head base hollow cavity 1091, the power supply circuit board 105 is provided with a switch control circuit consisting of several electronic elements, and the short distance light source and the long distance light source are electrically connected to the power supply by means of the switch control circuit. The switch control circuit includes a touch switch S and a controller U. The two ends of the touch switch S are electrically connected to a cathode and an anode of the power supply directly or indirectly. When the control switch 400 arranged at the outer surface of the lighting equipment is pressed or pushed by an external force, the touch switch S is turned on or off. The controller is a control chip U. The controller controls the light and shade state of the short distance light source and/or the long distance light source according to the number of times of on and off of the touch switch S. According to different types of the control chip and different structures of the switch control circuit, the lighting equipment of the present invention may have various light source control schemes.

Figure 12:
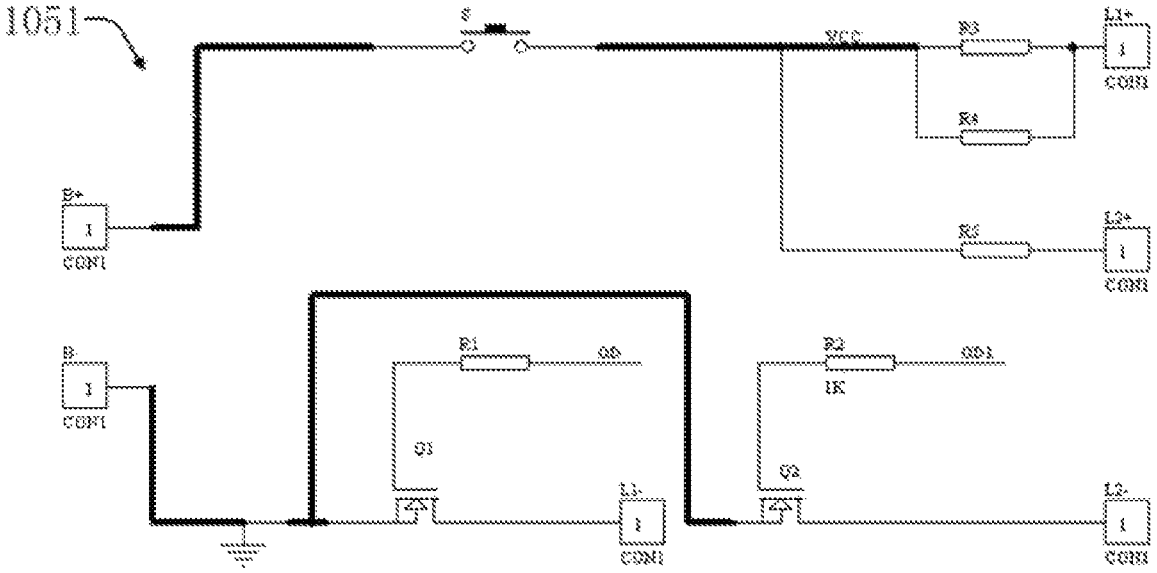
FIG. 12 is a circuit diagram of a main loop in the first embodiment of the present invention.
Figure 13:
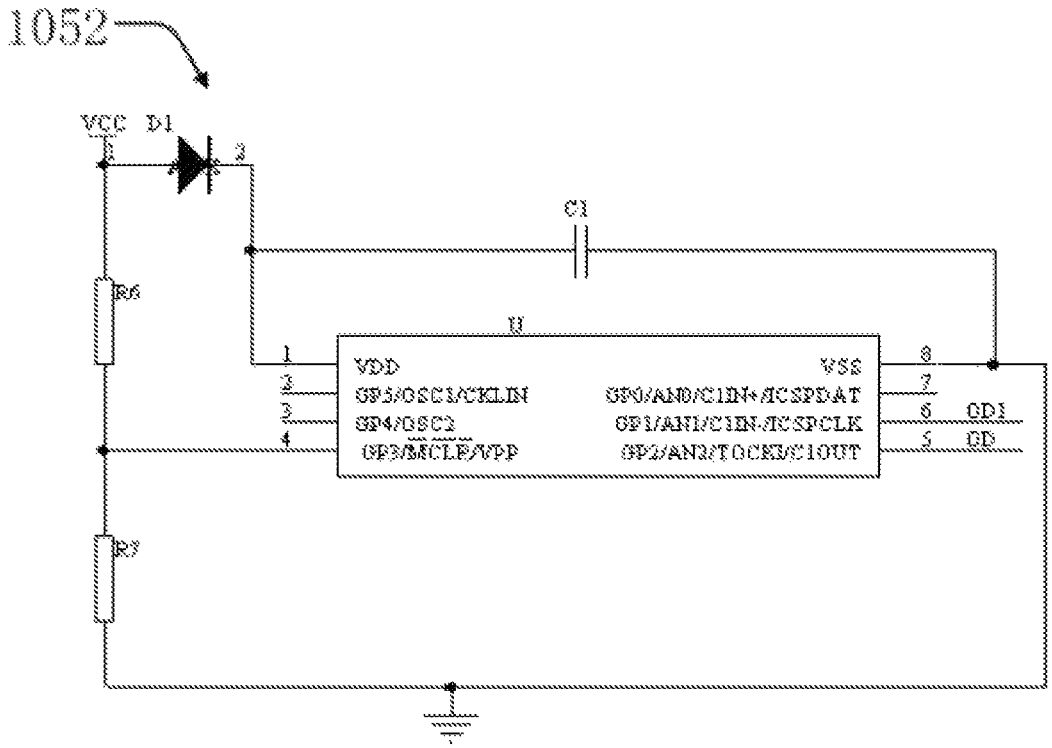
FIG. 13 is a circuit diagram of the control circuit in the first embodiment of the present invention.

As shown in FIGS. 12 and 13, in the present embodiment, the switch control circuit includes a main loop 1051 and a control circuit 1052. In the present embodiment, an MCV08A chip U is preferably taken as the controller, and is provided with 8 pins mainly including chip pins VDD, VSS, GP1, GP2, and the like. In the switch control circuit of the present embodiment, the power supply end pin VDD is electrically connected to the power supply anode VCC by means of one diode, a GND pin VSS is electrically connected to a power supply cathode (grounded), and output end pins GP1 and GP2 are electrically connected to the LED lamp plate 104 through one MOS transistor respectively. The two ends of the power supply are electrically connected to the two ends of the LED lamp plate 104 and the COB lamp plate 102 by means of electronic elements such as a wire, resistor or an MOS transistor, with reference to FIGS. 12 and 13 for details. The touch switch S is arranged on the main loop and is electrically connected to the power supply anode directly. When the touch switch S is turned on or off, the chip U controls the on and off of the LED lamp plate 104 and/or the COB lamp plate 102, thereby controlling the light and shade state of the LED lamp bead 1041 and/or the COB chip 1022. Specifically, the LED lamp bead 1041 or the COB chip 1022 emit light in the light state, but does not emit light in the shade state.

Figure 14:
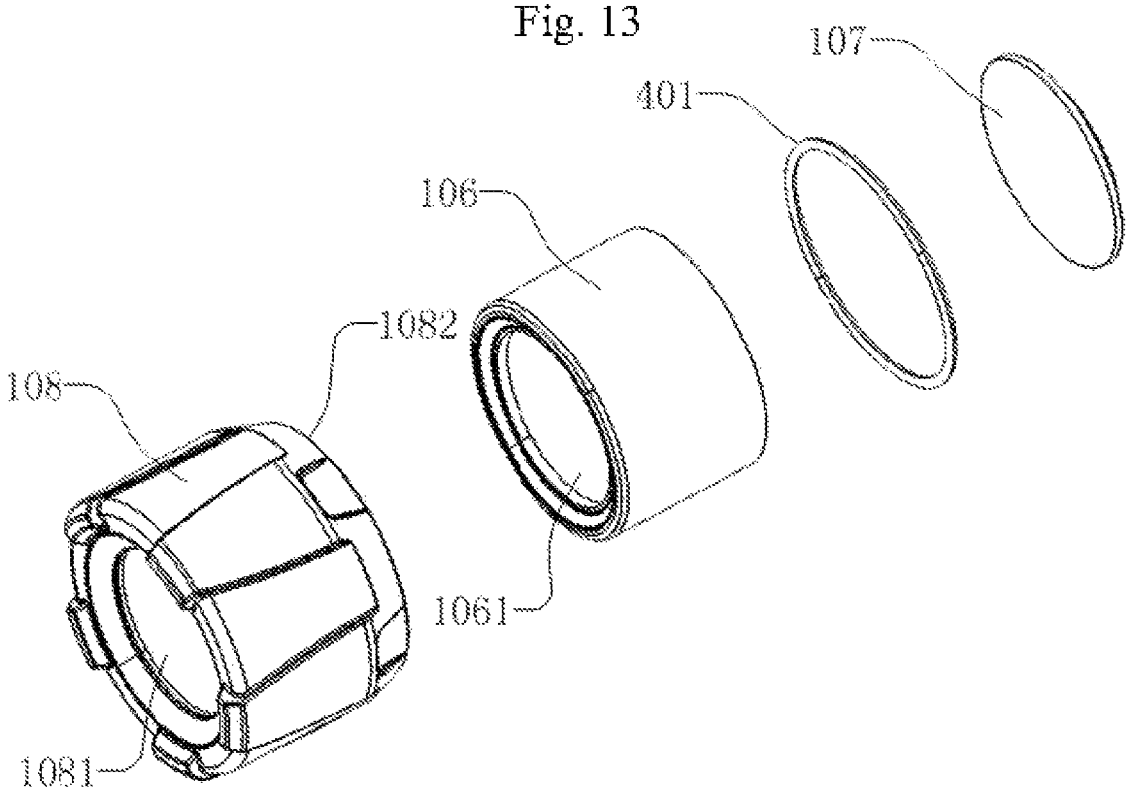
FIG. 14 is a schematic view showing the exploded state of the lamp head outer casing and the lamp head inner casing in the first embodiment of the present invention.

As shown in FIGS. 2-3, and 14, the lamp head portion 100 further includes a lamp head inner casing 106, a light transmitting member 107 and a lamp head outer casing 108. The lamp head inner casing 106 includes opposing inner casing light exit port 1061 and an inner casing opening 1062; a light transmitting member 107, preferably transparent glass, mounted to the inner casing light exit port 1061; a first sealing member 401 is provided at the joint between the inner casing light exit port 1061 and the light transmitting member 107, preferably a sealing ring, sheathing the outer side wall of the light transmitting member 107. The lamp head outer casing 108 includes opposing outer casing light exit port 1081 and outer casing opening 1082, the outer casing light exit port 1081 corresponding to the inner casing light exit port 1061, the outer casing opening 1082 sheathing the lamp head inner casing 106.

Figure 15:
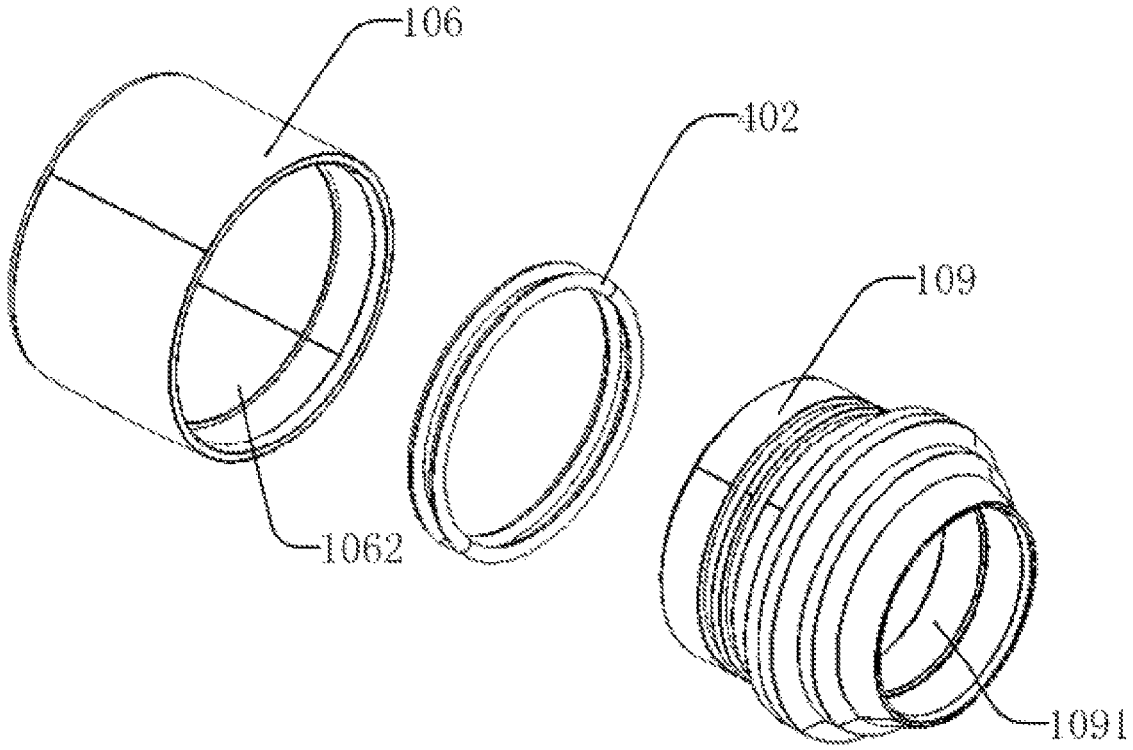
FIG. 15 is a schematic view showing the exploded state of the lamp head inner casing and the lamp head base in the first embodiment of the present invention.

As shown in FIGS. 2-3 and 15, the lamp head portion 100 further includes a lamp head base 109 mounted to the inner casing opening 1062 of the lamp head inner casing 106; the lamp head base 109 is provided with a lamp head base hollow cavity 1091 in the middle, one part of the lamp bead base 103 is inserted to the lamp head base hollow cavity 1091; a second sealing member 402 is provided at the joint between the lamp head base 109 and inner casing opening 1062, preferably two sealing rings, sheathing the outer side wall of the lamp head base 109.

Figure 16:
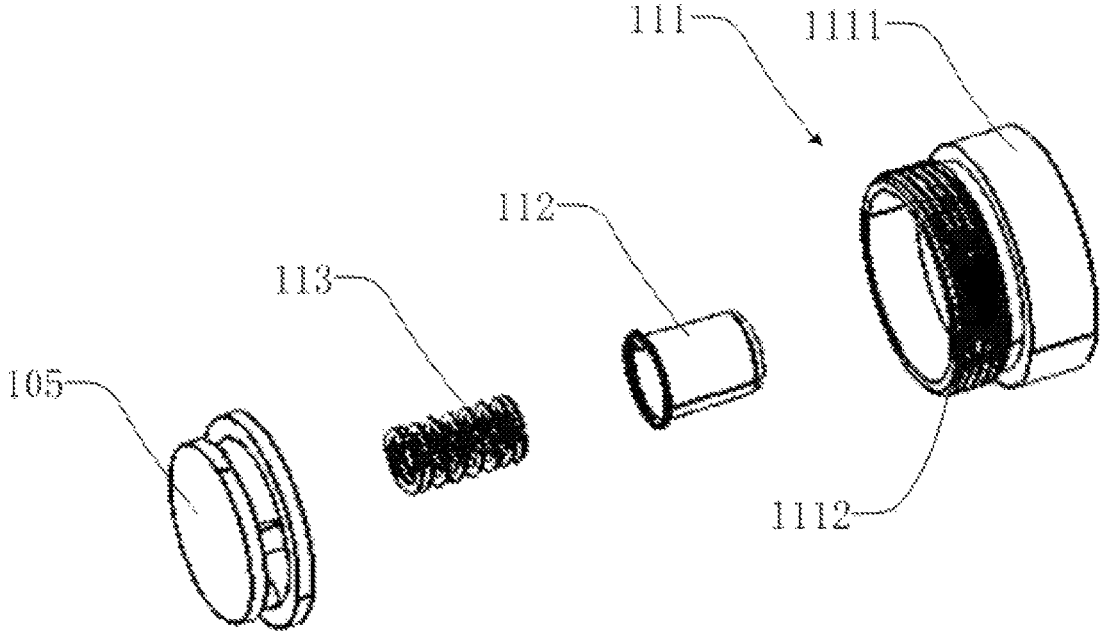
FIG. 16 is a schematic view showing the exploded state of the first conductive member and the first spring in the first embodiment of the present invention.

As shown in FIGS. 2-3 and 16, the lamp head base hollow cavity 1091 is provided therein with a first conductive member fixing base 111, a first conductive member 112 and a first spring 113 from the outside in. The first conductive member fixing base 111 is made of an insulated material, including a first fixing base body 1111 and a first connecting pipe 1112, which are integrated. The first fixing base body 1111 is provided with a first fixing base through hole 1113 in the middle. One end of the first conductive member 112 passes through the first fixing base through hole 1113 and is electrically connected to the power supply; the other end thereof is provided with a first conductive member recess 1121; one end of the first spring 112 is arranged in the first conductive member recess 1121, and the other end thereof is electrically connected to one conductor slice of the light source circuit board 105, preferably a first conductor slice 1051 in the present embodiment.

As shown in FIGS. 15-16, the first connecting pipe 1112 is connected to the lamp bead base 109, the outer side wall of the first connecting pipe 1112 is provided with threads; the inner side wall at the outmost end of the second hollow cavity of the lamp bead base 1033 is provided with threads, corresponding to the threads of the first connecting pipe 1112. The first connecting pipe 1112 is in threaded connection to the lamp bead base 109.

Figure 17:
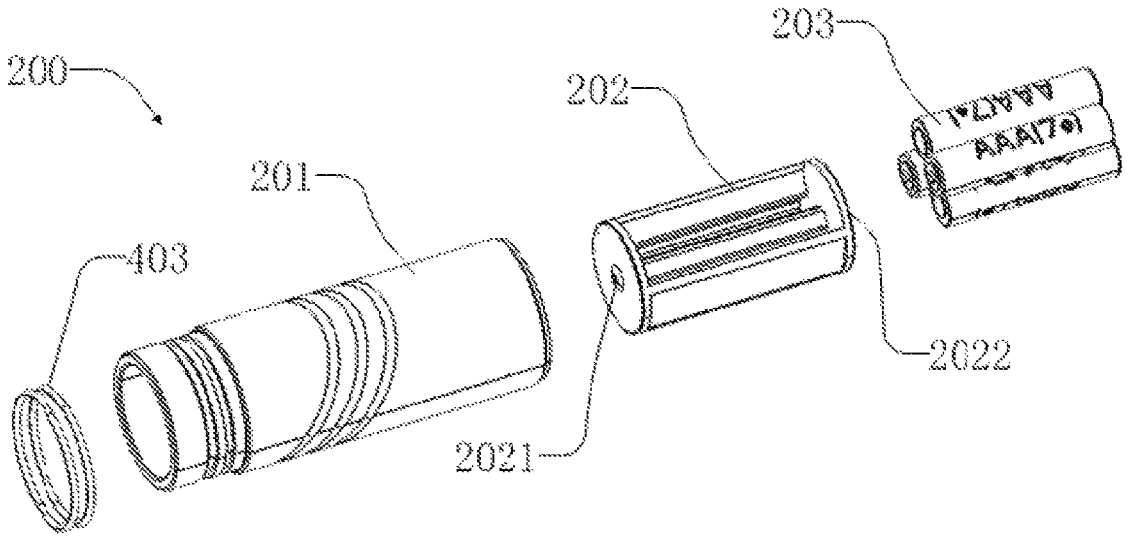
FIG. 17 is an exploded structural schematic view of the connecting portion in the first embodiment of the present invention.

As shown in FIG. 17, the connecting portion 200 includes a tube body 201, one end of which is inserted to the lamp head base hollow cavity 1091, and is connected to the lamp head base 109, and the other end of which is connected to the tail hood inner casing 301 of the tail portion. A third sealing member 403 is arranged at the joint between the tube body 201 and the lamp head base 109, preferably two sealing rings, sheathing the outer side wall of the lamp head base 109.

The tube body 201 is provided therein with at least one battery holder 202, preferably one in the present embodiment. Four batteries 203 are arranged in each battery holder 202 and are connected in series with each other to form the power supply (DC power supply) of the present embodiment. The two ends of the battery holder 202 is provided with a first contact 2021 and a second contact 2022, which are made of conductor materials, and form a connected circuit after being connected with other conductor members. The first contact 2021 is electrically connected to the first conductive member 112, the elastic force generated by compressing the first spring 112 makes the end portion of the first conductive member 112 stably contact the first contact 2021, without loosening, but ensuring circuit continuity.

Figure 18:
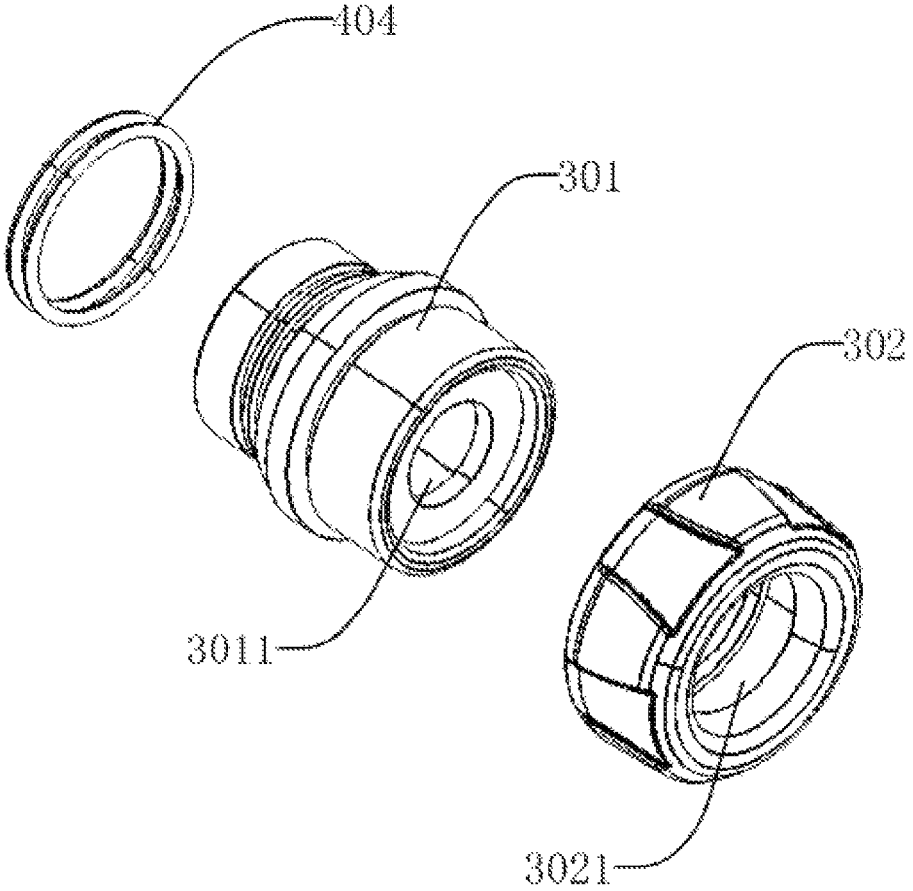
FIG. 18 is an exploded schematic view of the tail portion outer casing and the tail portion inner casing in the first embodiment of the present invention.

As shown in FIG. 18, the tail portion 300 includes a tail hood inner casing 301 and a tail hood outer casing 302. One end of the tail hood inner casing 301 is inserted to the tube body 201, and the other end thereof is provided with an inner casing switch through hole 3011; the joint between the tail hood inner casing 301 and the tube body 201 is provided with a fourth sealing member 404, preferably two sealing rings, sheathing the outer side wall of the tail hood inner casing 301. One end of the tail hood outer casing 302 sheathes the tail hood inner casing 301, and the other end thereof is provided with an outer casing switch through hole 3021, corresponding to the inner casing switch through hole 3011.

The tail hood inner casing 301 is provided therein with a push switch 307 and a switch circuit board 308. The tail hood inner casing 301 is provided therein with a tail hood conductive member, one end of which is connected to the second contact 2022 of the battery holder 202, the other end of which is electrically connected to the switch circuit board 308.

Figure 19:
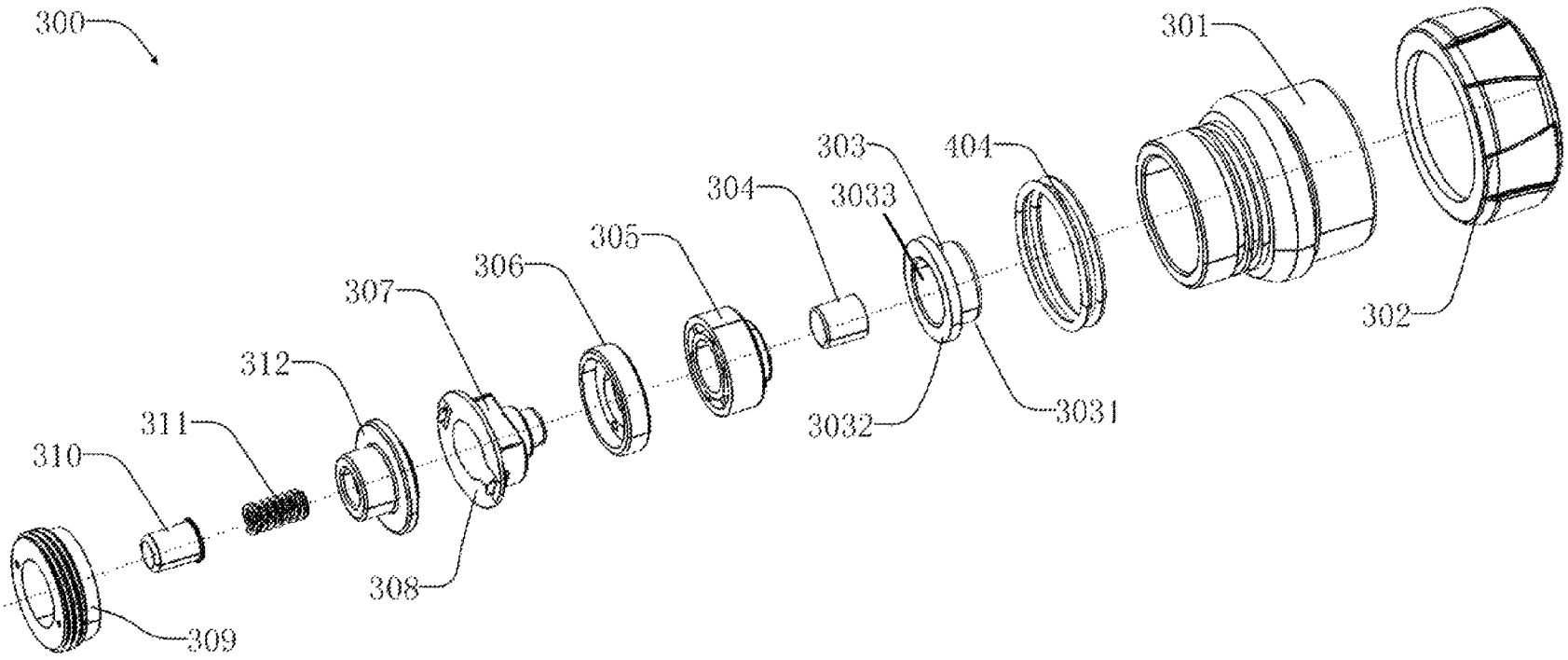
FIG. 19 is an exploded structural schematic view of the tail portion in the first embodiment of the present invention.

In the present embodiment, the internal structure of the tail hood inner casing 301 preferably has the following solution. As shown in FIG. 19, the tail hood inner casing 301 is provided therein with a switch cap 303, a switch peg 304, a switch cap lining ring 305, a switch cap clamping ring 306, a push switch 307 and a switch circuit board 308 from the outside in. The tail hood conductive member includes a third conductive member fixing base 309, a third conductive member 310 and a third spring 311 which passes through the switch plate clamping ring 312 and is connected to the switch circuit board 308.

The switch cap 303 includes a key 3031 and a key baffle 3032, which are integrated. The key 3031 passes through the inner casing switch through hole 3011, for the user to press easily. The size of the key baffle 3032 is larger than that of the inner casing switch through hole 3011; its surface is provided with a concave switch cap slot 3033. The switch cap lining ring 305 is fitted to the key baffle 3032; the switch cap clamping ring 306 is fitted to the switch cap lining ring 305, for damping and supporting the switch cap 303. The part of the control switch exposed to outside of the lighting equipment is only the key 3031 of the switch cap 303. The user may realize the on and off of the circuit by pressing or pushing the key 3031 of the switch cap 303 only using a thumb.

Figure 20:
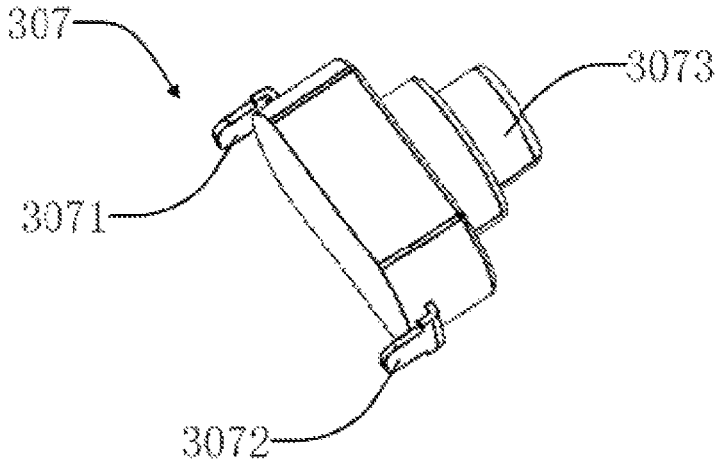
FIG. 20 is a structural schematic view of the push switch in the first embodiment of the present invention.
Figure 21:
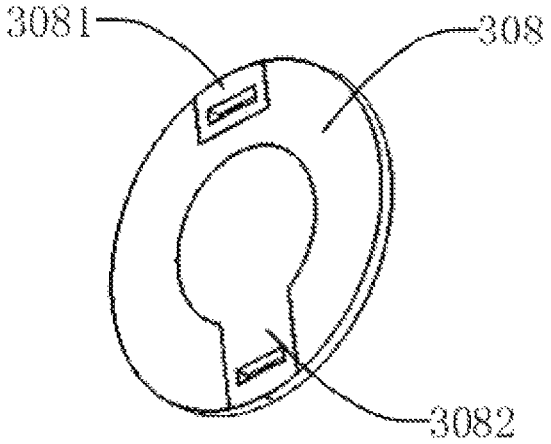
FIG. 21 is a structural schematic view of the switch circuit board in the first embodiment of the present invention.

As shown in FIG. 20, the push switch 307 includes two pins 3071, 3072 and a pressing end 3073; the pressing end 3073 is provided with a spring structure and a touch switch, the same as the prior art, so there is no repeated description herein. The pressing end 3073 passes through the switch cap clamping ring 305 and the switch cap lining ring 306 and is fitted to one end of the switch peg 304 away from the switch cap 303; the other end of the switch peg 304 is inserted to the switch cap slot 3033. As shown in FIG. 21, the switch circuit board 308 includes two insulated conductor slices 3081 and 3082, which are electrically connected to the two pins 3071 and 3072 of the push switch 307 respectively.

Figure 22:
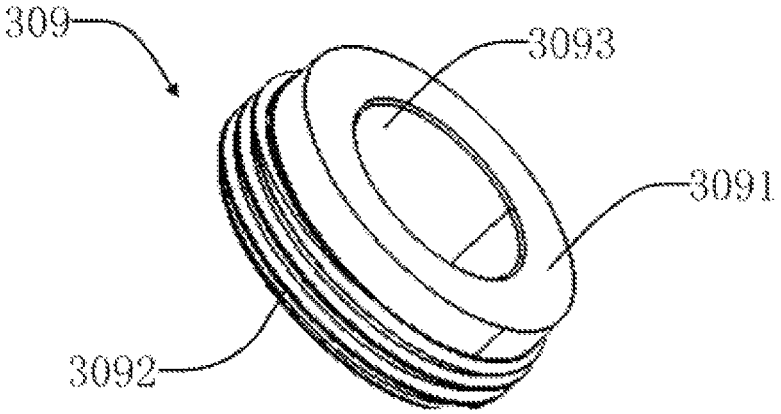
FIG. 22 is a structural schematic view of the third conductive member fixing base in the first embodiment of the present invention.

As shown in FIG. 22, the third conductive member fixing base 309 includes a third fixing base body 3091 and a third connecting pipe 3092, which are integrated. The third fixing base body 3091 is provided with a third fixing base through hole 3093 in the middle. The outer side wall of the third connecting pipe 3092 is provided with threads and can be in threaded connection to the inner side wall at one end of the tail hood inner casing 301.

One end of the third conductive member 310 passes through the third fixing base through hole 3093 and is electrically connected to the second conduct 2022 of the battery holder; the other end thereof is provided with a third conductive member recess 3101; one end of the third spring 311 is provided inside the third conductive member recess 3101, the other end thereof passes through the third connecting pipe 3092 and is electrically connected to the switch circuit board 308. The second contact 2022 is electrically connected to the third conductive member 310, and the elastic force generated by compressing the first spring 311 makes the end portion of the third conductive member 110 stably contact the second contact 2022, without loosening, thereby ensuring the continuity of the circuit. The first conductive member 112, the third conductive member 310 and the corresponding spring structure can ensure that there is no short circuit, which increases the stability of the circuit system.

In the present embodiment, the two ends of the connecting portion 200 are provided with a lamp head portion 100 and a tail portion 300 respectively. The lamp head portion 100 is provided therein with a long distance light source and a short distance light source. The connecting portion 200 is provided therein with a power supply. The tail portion 300 is provided therein with a control switch 400. The long distance light source and the short distance light source are connected in parallel and connected to the power supply and the control switch in series, to form a loop.

The lighting equipment of the present embodiment has three work gears, all of which are controlled by the controller U. The three work gears are respectively a first gear, at which the LED lamp bead 1041 and the COB chip 1022 emit light simultaneously; a second gear, at which only the LED lamp bead 1041 emits light; and a third gear, at which only the COB chip 1022 emits light. The switch of the work gears is realized by pressing or pushing the control switch using an external force. The user can press or push the control switch by a single hand, to obtain different light effects.

As shown in FIG. 12-13, when the lighting equipment according to the present embodiment is in an out-of-service state, the touch switch in the switch control circuit is in an off state, and neither the long distance light source nor the short distance light source emits light.

When the control switch is pressed or pushed by an external force for the first time, the touch switch S is turned on for the first time, the chip U is energized, both the chip pin GP2 (OD) and the chip pin GP1 (OD1) output high level, thereby turning on the MOS transistors Q1 and Q2 (equivalent to an electronic switch). The circuit forms a loop, and at this time, the LED lamp bead 1041 and the COB chip 1022 emit light simultaneously.

When the control switch is pressed or pushed by an external force for the second time, the touch switch S is turned off, the circuit loop is disconnected, and neither the LED lamp bead 1041 nor the COB chip 1022 emits light.

When the control switch is pressed or pushed by an external force for the third time, the touch switch S is turned on for the second time, the chip U is energized, the chip pin GP2 (OD) outputs high level, and the GP1 pin (OD1) outputs low level, thereby turning on the MOS transistor Q1 and turning off the MOS transistor Q2. The circuit forms a loop. At this time, only the LED lamp bead 1041 emits light, but the COB chip 1022 does not emit light.

When the control switch is pressed or pushed by an external force for the fourth time, the touch switch S is turned off again, the circuit loop is disconnected, and neither the LED lamp bead 1041 nor the COB chip 1022 emits light.

When the control switch is pressed or pushed by an external force for the fifth time, the touch switch S is turned on for the third time, the chip U is energized, the chip pin GP2 (OD) outputs low level, and the GP1 pin (OD1) outputs high level, thereby turning on the MOS transistor Q2, and turning off the MOS transistor Q1. The circuit forms a loop. At this time, the LED lamp bead 1041 does not emit light, but only the COB chip 1022 emits light.

When the control switch is pressed or pushed by an external force for the sixth time, the touch switch S is turned off again, the circuit loop is disconnected, and neither the LED lamp bead 1041 nor the COB 1022 emits light.

In the present embodiment, gaps possibly existing on the outer surface of the lighting equipment are provided with sealing members. The joint between the inner casing light exit port 1061 and the light transmitting member 107 is provided with a first sealing member 401, the joint between the lamp head base 109 and the inner casing opening 1062 is provided with a second sealing member 402, the joint between the tube body 201 and the lamp head base 109 is provided with a third sealing member 403, and the joint between the tail hood inner casing 301 and the tube body 201 is provided with a fourth sealing member 404. As for the four sealing members, preferably one or two sealing rings, the overall sealing effect of the lighting equipment can be effectively improved, which can prevent external water from entering, and avoid corrosion and damage of members and short circuits of the whole circuit.

The present embodiment has the advantageous effects that both the LED light source and the COB light source are provided, so the user can flexibly control the two groups of light sources simply by using a single hand, which is simple in operation and convenient in use. The present invention has good circuit stability and low fault rate. The present invention has good water-proof performance, can be used for wet environments and is easy to market application. In addition, the present invention is provided with two groups of adjacent light sources at the same time which give out heat simultaneously. The present invention has good heat dissipation performance, can rapidly and effectively radiate heat, and prevents parts from being malfunctioned.

Second Embodiment

Figure 23:
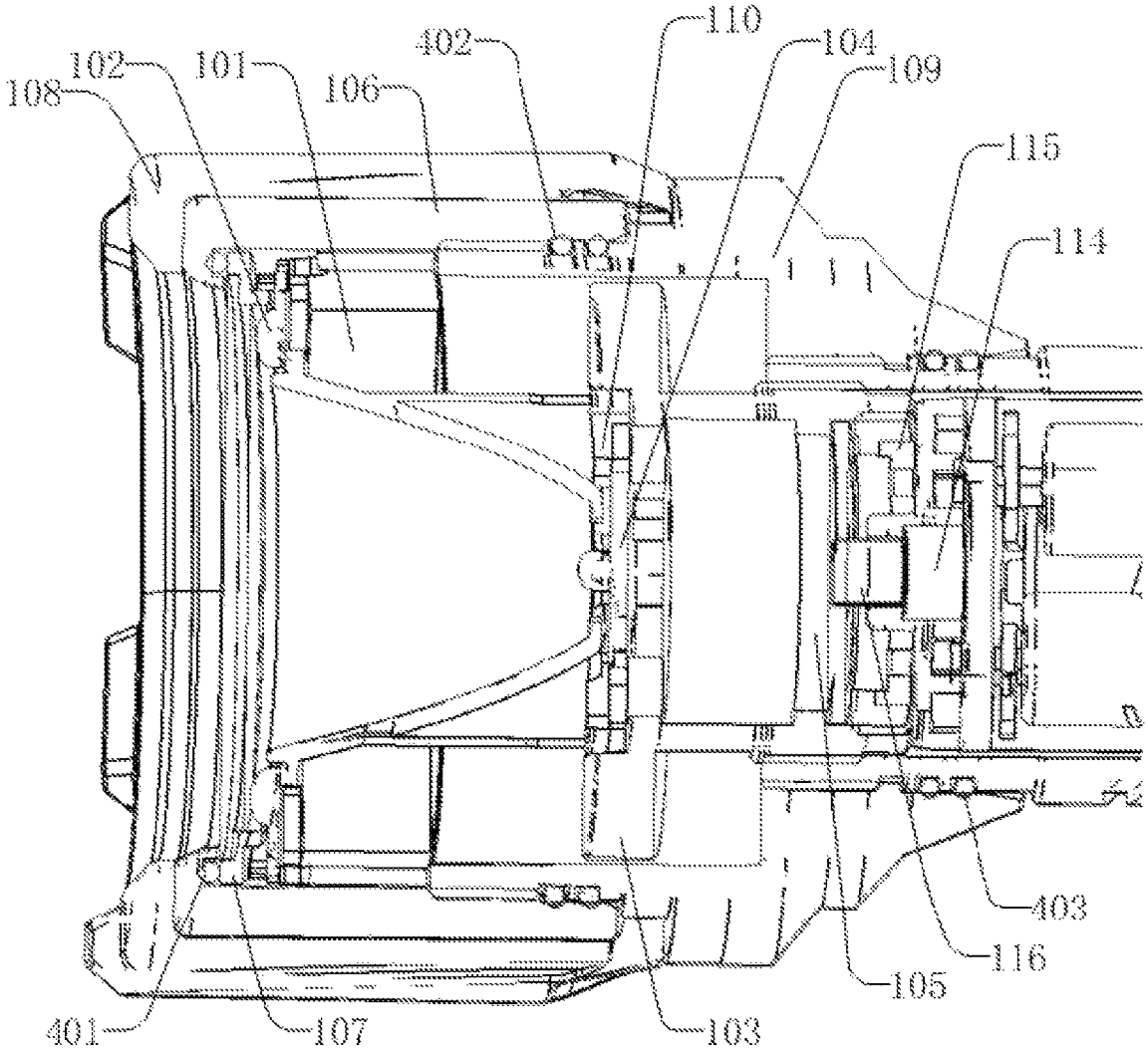
FIG. 23 is a sectional structural schematic view of the lamp head portion in the second embodiment of the present invention.
Figure 24:
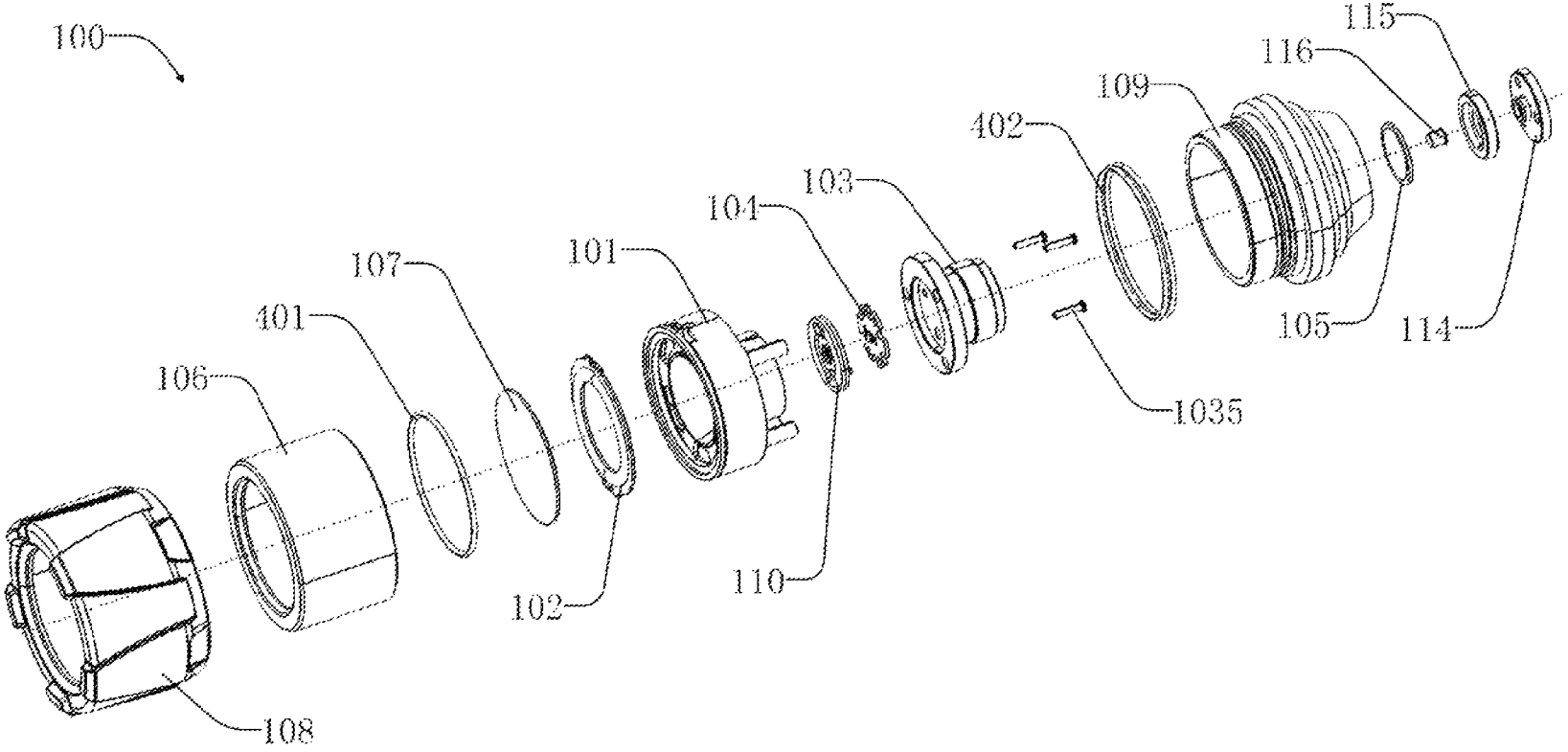
FIG. 24 is an exploded structural schematic view of the lamp head portion in the second embodiment of the present invention.

As shown in FIGS. 23-24, most of the technical solutions in the present embodiment are the same as the first embodiment. The same technical solutions are not repeated herein, and their distinctive technical features refer to the following for details.

Figure 25:
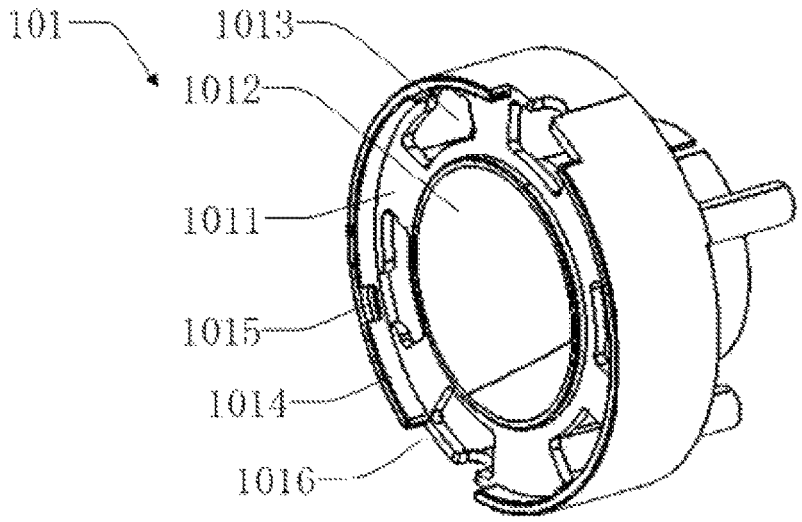
FIG. 25 is a structural schematic view of the front of the reflective member in the second embodiment of the present invention.
Figure 26:
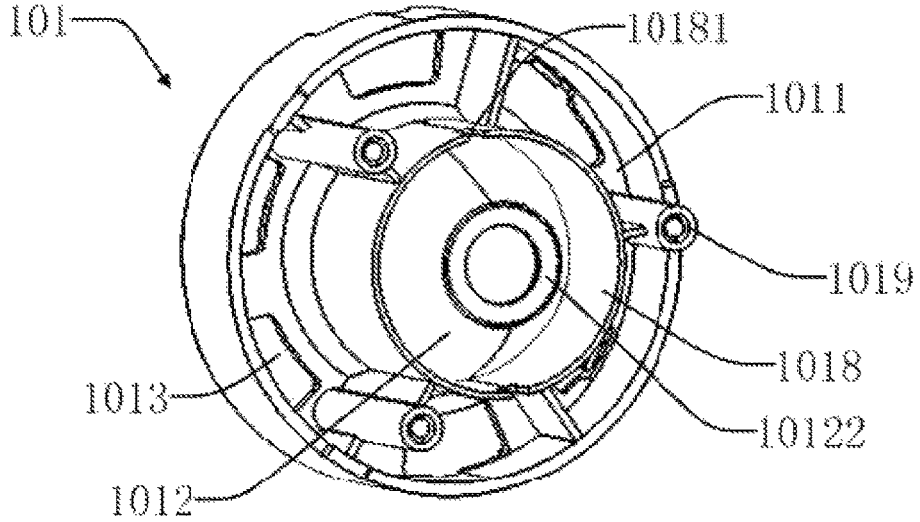
FIG. 26 is a structural schematic view of the back of the reflective member in the second embodiment of the present invention.

As shown in FIGS. 25-26, the reflective member 101 does not include a heat fin 1017, but only includes a heat sink 1018. The heat sink 1018 is provided thereon with a heat sink notch 10181. Various kinds of wires may pass through the heat sink notch 10181. The structural features of other members of the reflective member 101 are consistent with those in the first embodiment, without repeated description herein.

Figure 27:
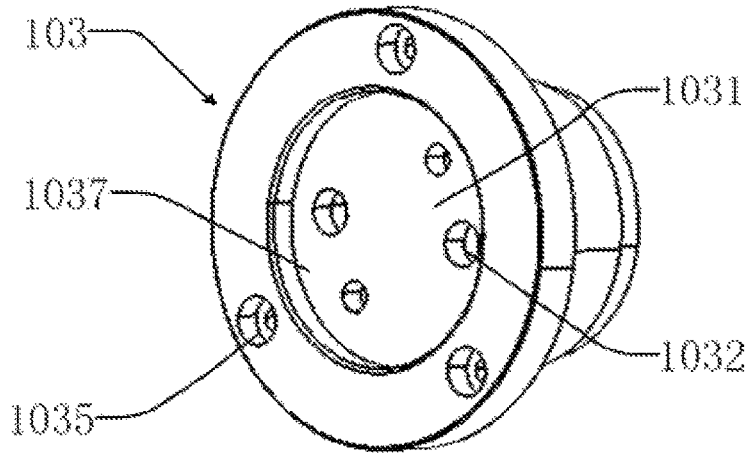
FIG. 27 is a structural schematic view of the front of the lamp bead base in the second embodiment of the present invention.
Figure 28:
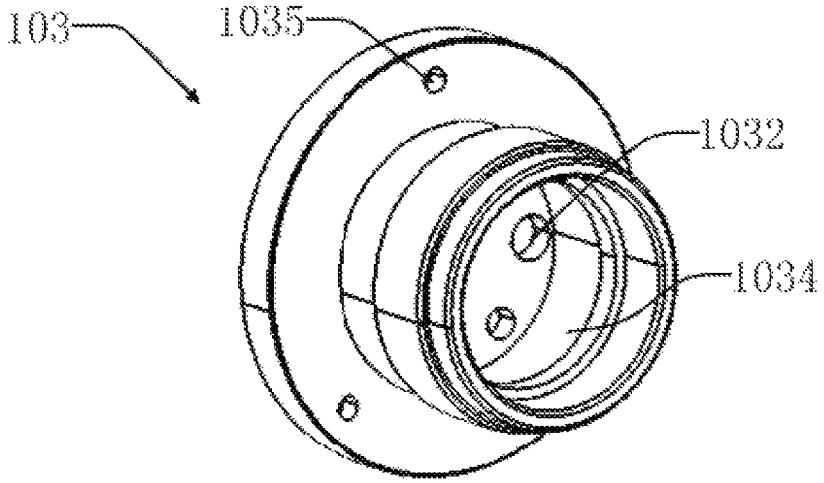
FIG. 28 is a structural schematic view of the back of the lamp bead base in the second embodiment of the present invention.

As shown in FIGS. 27-28, the lamp bead base 103 does not include a first hollow cavity of the lamp bead base 1033, but includes a lamp bead mounting slot 1035; the lamp bead mounting slot 1035 and the second hollow cavity of the lamp bead base 1034 are arranged at the two sides of the lamp bead base partition plate 1031 respectively; the LED lamp plate 104 is mounted inside the lamp bead mounting slot 1035. The structural features of other members of the lamp bead base 103 are consistent with those in the first embodiment, without repeated description herein.

As shown in FIGS. 23-24, the lamp bead base 103 is fixedly connected to the reflective member 101; the reflective member main plate 1011 is provided with several reflective member fixing holes 1019, the lamp bead base 103 is also provided with several lamp bead base fixing holes 1035 at one side toward the reflective member 101. The two groups of fixing holes correspond one to one. A plurality of connecting screw rods 1036 is inserted to the reflective member fixing hole 1019 and the lamp bead base fixing hole 1035 from the direction of the lamp bead base 103, to fix both the reflective member fixing hole 1019 and the lamp bead base fixing hole 1035 with each other. Preferably, three connecting screw rods are used.

Figure 29:
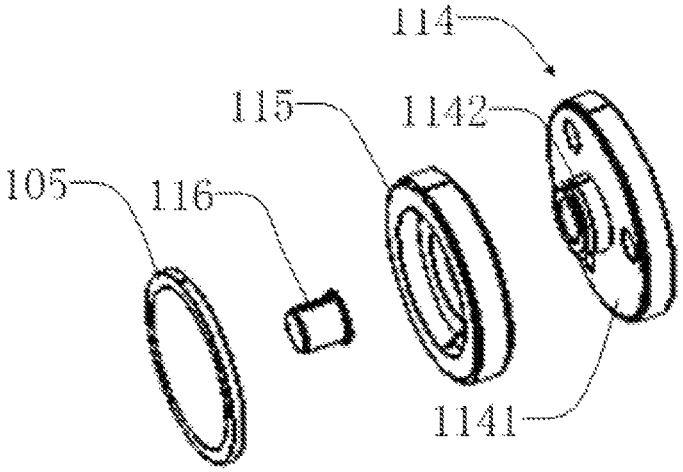
FIG. 29 is a schematic view showing the structure of the second conductive member and the second conductive member fixing base in the second embodiment of the present invention.

As shown in FIG. 29, the lamp head base hollow cavity 1091 is provided therein with a second conductive member fixing base 114, a second conductive member gasket 115 and a second conductive member 116 from the outside in. The second conductive member fixing base 114 is made of an insulated material, including a second fixing plate 1141 and a second connecting pipe 1142, which are integrated. The second fixing plate 1141 is provided with a second fixing plate through hole 1143 in the middle, the second fixing plate 1141 is fixedly connected to the battery holder 202 by means of at least one fastener (such as a screw). A second conductive member gasket 115 is provided between the second fixing plate 1141 and the power supply circuit board 105, one end of the second conductive member 112 is electrically connected to one conductor slice of the power supply circuit board 105, preferably a first conductor slice 1053, and the other end thereof passes through the second connecting pipe 1142 and the second conductive member gasket 115 and is electrically connected to the power supply. In the present embodiment, the tube body 201 is inserted to the lamp head base hollow cavity 1091 and fixed to the lamp head base 109; the power supply circuit board 105 is fixed inside the tube body 201 and clings to the second conductive member gasket 105; the second conductive member gasket 105 clings to the second fixing plate 1141, and the second connecting pipe 1142 is inserted into the second conductive member gasket 105; one end of the second conductive member 112 is electrically connected to the first conductor slice 1053, and the other end thereof is electrically connected to the first contact 2021 of the battery holder 202, and its two ends are fixed well to ensure the continuity of the circuit.

Figure 30:
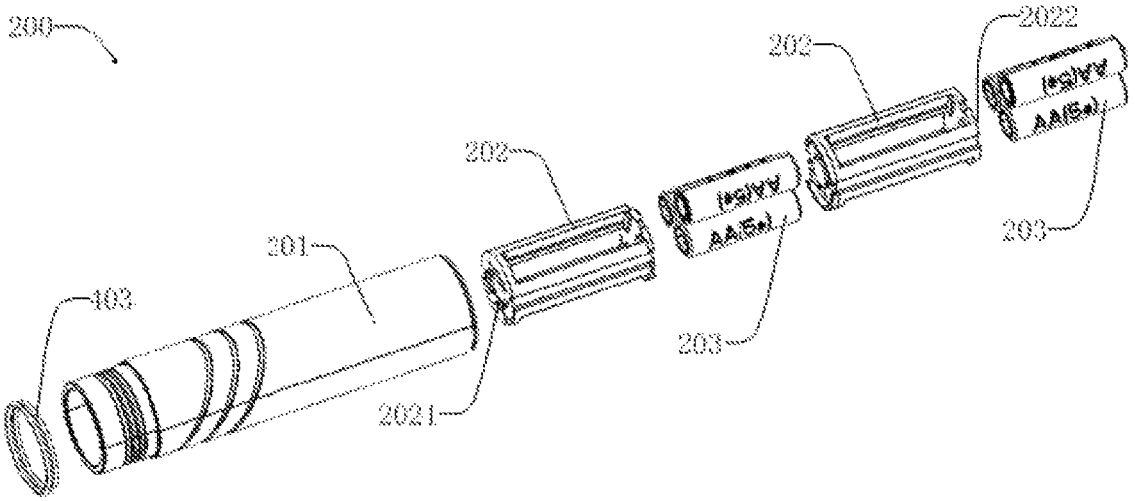
FIG. 30 is an exploded structural schematic view of the connecting portion in the second embodiment of the present invention.

As shown in FIG. 30, the connecting portion 200 includes a tube body 201 which is provided therein with two battery holders 202 connected in series with each other to form one power supply. The two ends of the outermost side of the power supply are provided with a first contact 2021 and a second contact 2022. Each battery holder 202 is provided therein with three batteries 203.

Figure 31:
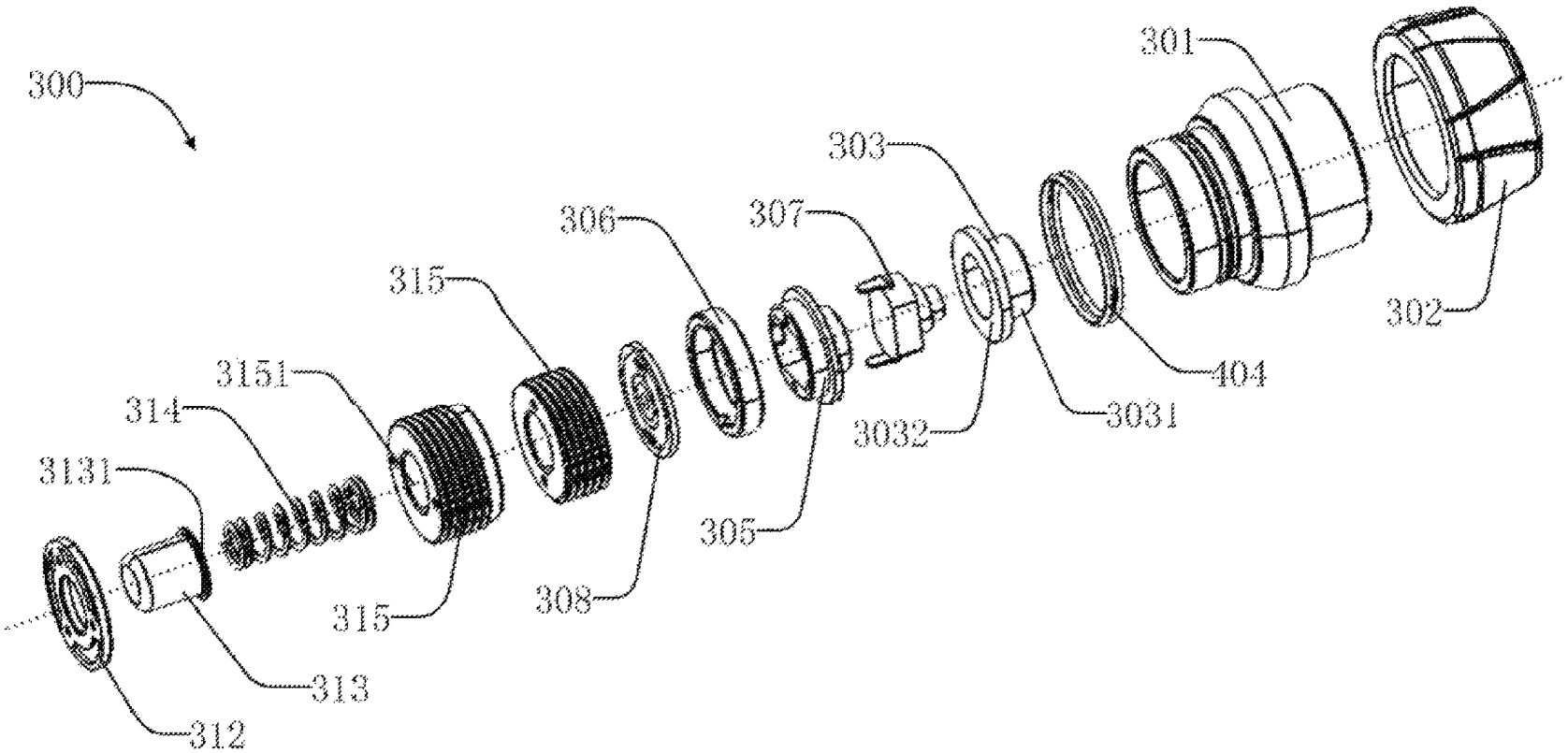
FIG. 31 is an exploded structural schematic view of the tail portion in the second embodiment of the present invention.

In the present embodiment, the internal structure of the tail hood inner casing preferably has the following solution. As shown in FIG. 31, the tail hood inner casing 301 is provided therein with a switch cap 303, a push switch 307, a switch cap clamping ring 306, a switch cap lining ring 305, and a switch circuit board 308 from the outside in. The tail hood conductive member includes a tail hood clamping ring 312, a fourth conductive member 313, a fourth spring 314 and a fourth conductive member fixing base 315.

Figure 32:
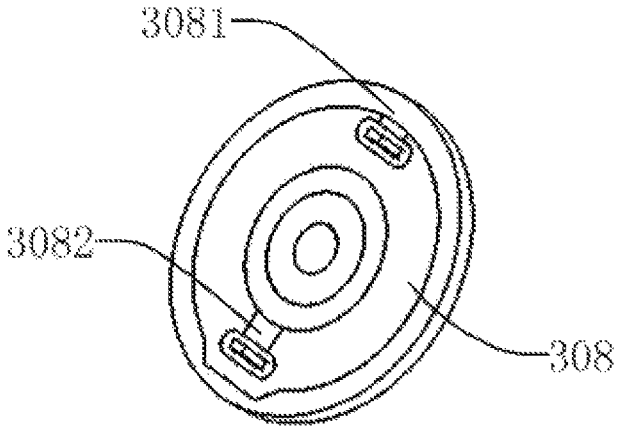
FIG. 32 is a structural schematic view of the switch circuit board in the second embodiment of the present invention.

The push switch 307 includes two pins 3071, 3072 and a pressing end 3073; the pressing end 3073 is located in the switch cap slot 3033; the switch cap clamping ring 305 is fitted to the push switch 307; the switch cap lining ring 306 is fitted to the switch cap clamping ring 305; as shown in FIG. 32, the switch circuit board 308 includes two insulated conductor slices 3081 and 3082. The two pins 3071, 3072 of the push switch 307 successively passes through the switch cap clamping ring 305 and the switch cap lining ring 306 and are electrically connected to the two conductor slices 3081 and 3082 respectively.

In the present embodiment, there are two fourth conductive member fixing bases 315, the side walls of which are provided with threads, so the conductive member fixing bases 315 can be in threaded connection into the tail hood inner casing 301, and a fourth fixing base through holes 3151 is provided in the middle. One end of the fourth conductive member 313 passes through the tail hood clamping ring 312 and is electrically connected to the second contact 2022 of the battery holder; the other end thereof is provided with a fourth conductive member recess 3131. One end of the fourth spring 314 is arranged in the fourth conductive member recess 3131, and the other end thereof passes through the fourth fixing base through hole 3151 and is electrically connected to the switch circuit board 308.

The second contact 2022 is electrically connected to the fourth conductive member 313, and the elastic force generated by compressing the fourth spring 314 makes the end portion of the fourth conductive member 313 stably contact the second contact 2022, without loosening, thereby ensuring the continuity of the circuit. The second conductive member 116, the fourth conductive member 313 and its surrounding members can ensure that there is no short circuit, which increases the stability of the circuit system.

In the present embodiment, the connecting portion 200 is provided therein with a power supply. The tail portion 300 is provided therein with a control switch. The long distance light source and the short distance light source are connected in parallel, and are connected to the power supply and the control switch in series to form a loop.

As for the lighting equipment according to the present embodiment, its switch circuit structure and its light control effects are the same as those in the first embodiment, and its sealing member structure and mounting position are the same as those in the first embodiment, without repeated description herein.

The present embodiment has the advantageous effects that both the LED light source and the COB light source are provided, so the user can flexibly control the two groups of light sources simply by using a single hand, which is simple in operation and convenient in use. The present invention has good circuit stability and low fault rate. The present invention has good water-proof performance, can be used for wet environments and is easy to market application. In addition, the present invention has good heat dissipation performance, can rapidly and effectively radiate heat, and prevents parts from being malfunctioned.

Third Embodiment

Figure 33:
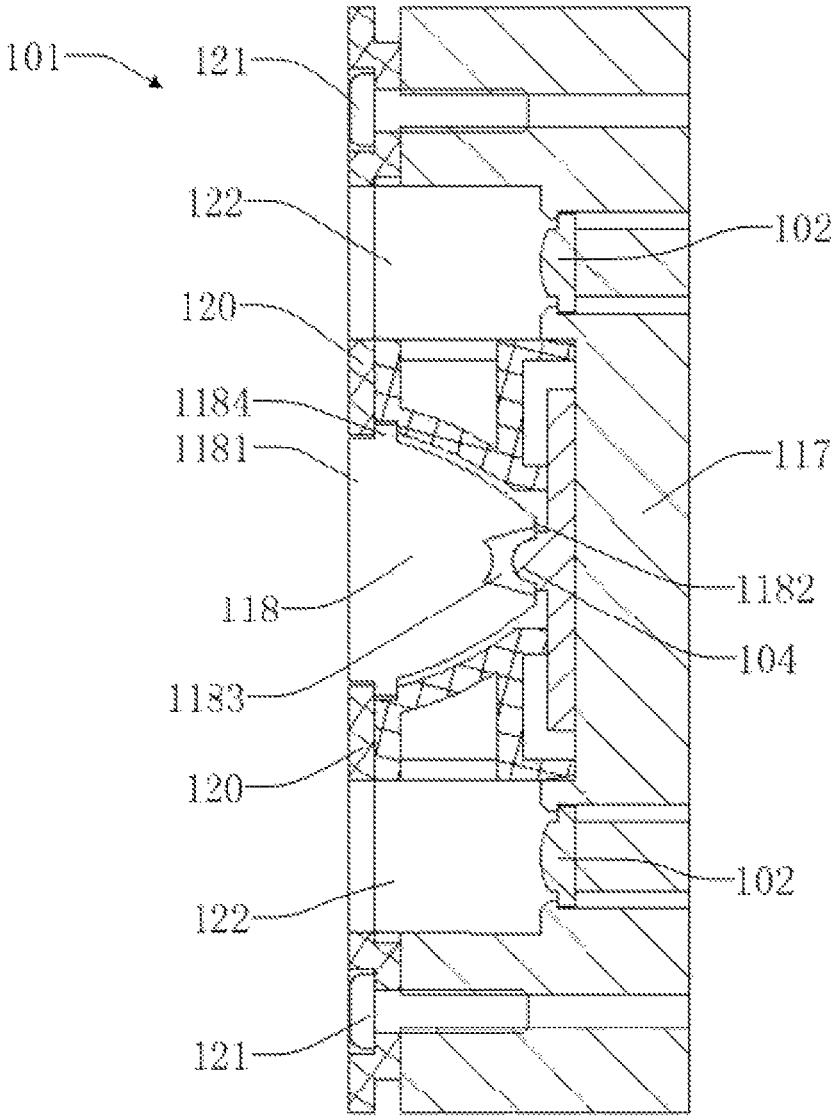
FIG. 33 is a sectional structural schematic view of the lamp head portion in the third embodiment of the present invention.

As shown in FIG. 33, most of the technical solutions in the present embodiment are the same as the first embodiment or the second embodiment. Their distinctive technical features refer to the following for details.

The lamp head portion 100 includes a light source bracket 117, for mounting the short distance light source and the long distance light source which are located on the same plane. The short distance light source is preferably one COB lamp plate, and the long distance light source is preferably one LED lamp plate. That is, the COB lamp plate 102 and the LED lamp plate 104 are located on the same plane.

The lamp head portion 100 further includes a tapered lens 118 and a lens bracket 119.

Figure 34:
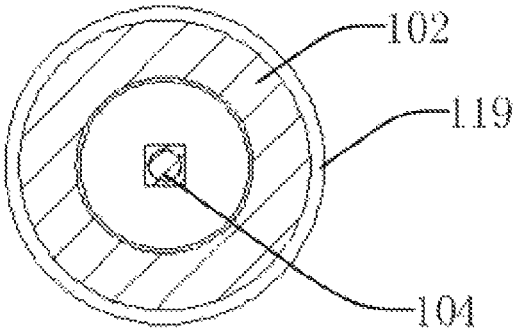
FIG. 34 is a schematic view showing the layout of a first light source in the third embodiment of the present invention.
Figure 35:
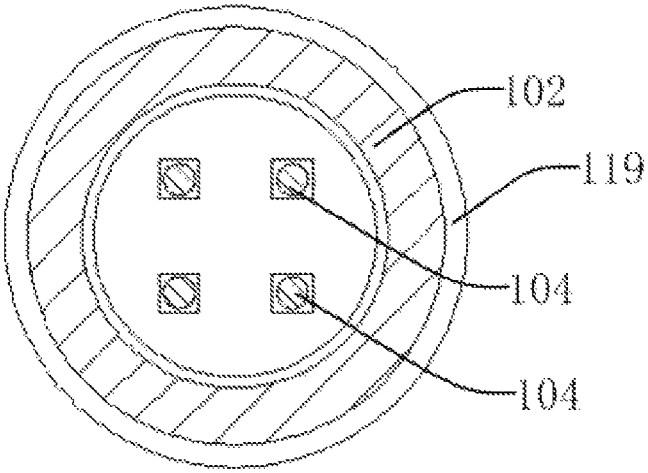
FIG. 35 is a schematic view showing the layout of a second light source in the third embodiment of the present invention.
Figure 36:
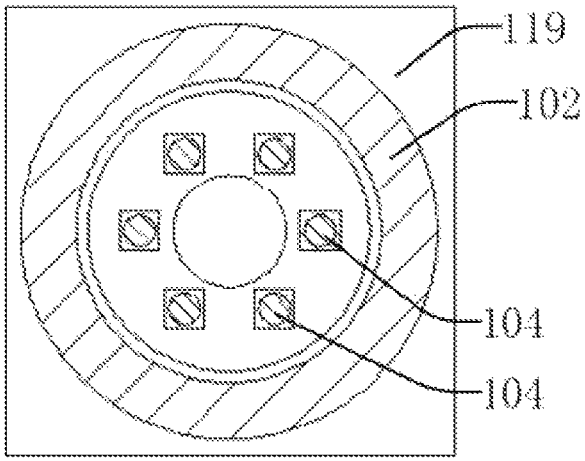
FIG. 36 is a schematic view showing the layout of a third light source in the third embodiment of the present invention.

The two ends of the tapered lens 118 are a large lens face 1181 and a small lens face 1182 respectively, the small lens face 1182 provided with a lens recess 1183 in the middle; the lens bracket 119 is used for mounting the tapered lens 118, the shape of the lens bracket 119 corresponds to that of the tapered lens 118; the LED lamp plate 104 is provided with at least one LED lamp bead 1041 in the middle, protruding to the lens recess 1183. As shown in FIGS. 34-36, the number of the LED lamp beads 1041 may be one, four or six.

The lens bracket 119 is fixedly connected to the light source bracket 117 through at least one fastener. In the present embodiment, the fastener is preferably a bracket screw 121.

The lamp head portion 100 further includes an annular cover plate 120 which is fixed to the light source bracket 117 by the fastener. The annular cover plate 120 and the large lens face 1181 are located in the same plane. The side wall edge of the tapered lens 118 is provided with an annular projection 1184, which is close to the large lens face 1181. The inner side of the lens bracket 119 is provided with an annular recess (not shown in the drawing), corresponding to the annular projection 1184; the annular projection 1184 is engaged into the annular recess. The internal diameter of the annular cover plate 120 is less than the external diameter of the annular projection 1184, thereby fixing the tapered lens 118 on the lens bracket 119.

The tapered lens 118 is a convex lens. The LED lamp bead 1041 is a point light source, and after refracted by the tapered lens 118 the ray of light emitted by the LED lamp bead 1041 forms a parallel light beam and then is emitted, thereby ensuring the irradiation effect.

Figure 37:
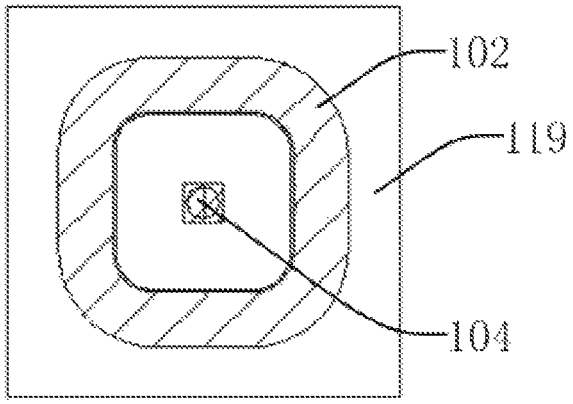
FIG. 37 is a schematic view showing the layout of a fourth light source in the third embodiment of the present invention.
Figure 38:
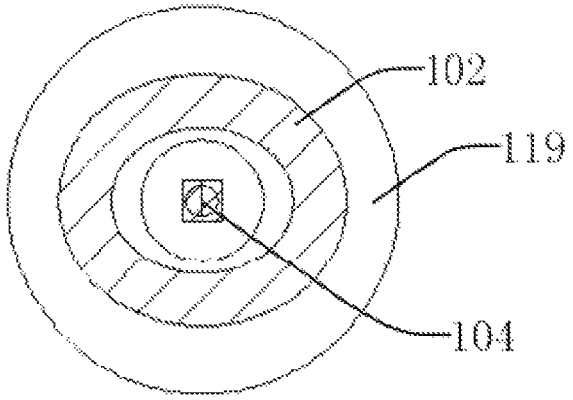
FIG. 38 is a schematic view showing the layout of a fifth light source in the third embodiment of the present invention.

In the present embodiment, the COB lamp plate 102 can be annular, enclosed outside the LED lamp plate 104; as shown in FIG. 34, 37-38, its shape can be circle, oval, rectangle or round rectangle.

Figure 39:
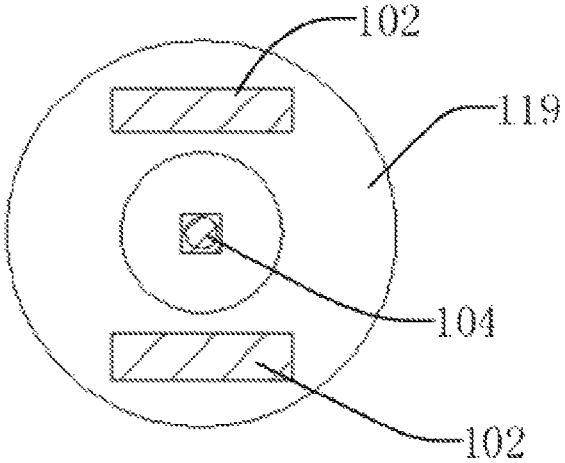
FIG. 39 is a schematic view showing the layout of a sixth light source in the third embodiment of the present invention.
Figure 40:
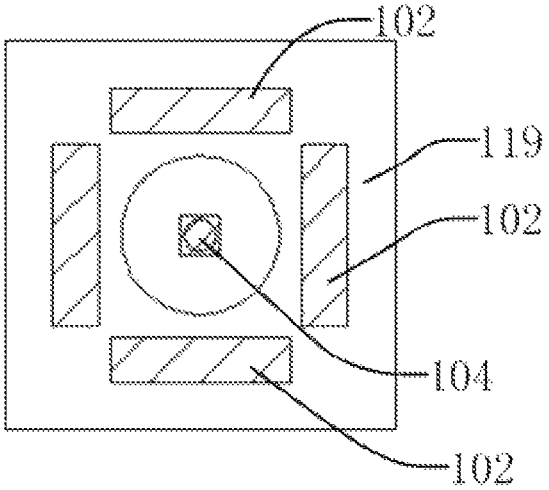
FIG. 40 is a schematic view showing the layout of a seventh light source in the third embodiment of the present invention.

The COB lamp plate 102 can be strip-shaped and is arranged next to the LED lamp plate 104. As shown in FIGS. 39-40, the number of the COB lamp plates 102 can be plural, preferably two or four.

The lens bracket 119 is provided therein with an annular hollow cavity 122, enclosed outside the tapered lens 118, corresponding to the COB lamp plate 102. The emitting chip on the COB lamp plate 102 is annular, and its emitted rays of light are parallel, emitted through the annular hollow cavity 122. The COB lamp plate 102 is combined with the LED lamp plate 104, with both the long distance light effect and the short distance light effect, so the user can make adjustments as appropriate.

In the present embodiment, the shape and structure of the light source bracket 117 and the lens bracket 119 can be appropriately adjusted, to be made into a circle, a square, or other shapes, such that the lamp is artistic on the whole. A manufacturer can adjust the light source layout on the front of the lamp head portion 100 by improving the number of lamp beads on the LED lamp plate 104, the shape of the COB lamp plate 102 and the shape of the lens bracket 119, so as to obtain different illumination effects and visual effects. The specific light source layouts refer to FIGS. 34-40 for details.

As for the lighting equipment according to the present embodiment, its switch circuit structure and its light control effects are the same as those in the first embodiment, and its sealing member structure and mounting position are the same as those in the first embodiment, and the structures, functions and theories of its connecting portion 200 and tail structure 300 are the same as those in the first or second embodiment, without repeated description herein.

The present embodiment has the advantageous effects that both the LED light source and the COB light source are provided in the same plane, which can further reduce the volume of the lamp head portion, such that the lighting equipment has small volume as a whole, is portable and is more artistic. Meanwhile, the user can flexibly control the two groups of light sources simply by using a single hand, which is simple in operation and convenient in use. In addition, the present invention has good heat dissipation performance, can rapidly and effectively radiate heat, and prevents parts from being malfunctioned.

The above is only the preferable embodiments of the present invention. It is to be pointed out that for persons skilled in the art, without departing from the principle of the present invention, several improvements and polishments which can be further made shall be taken within the protection scope of the present invention.

The invention claimed is:

1. A lighting equipment, successively comprising a lamp head portion, a connecting portion and a tail portion;

wherein the lighting equipment further comprises:

a short distance light source arranged inside the lamp head portion;

a long distance light source arranged inside the lamp head portion, a light emitting direction thereof being consistent with a light emitting direction of the short distance light source;

a power supply provided inside the connecting portion, positive and negative electrodes thereof being electrically connected to two ends of the short distance light source and two ends of the long distance light source respectively; and a control switch provided at a surface of the connecting portion and/or the tail portion, for controlling a light and shade state of the short distance light source and/or the long distance light source respectively;

wherein the lamp head portion comprises a reflective member comprising the following that are integrally formed:

a reflective member main plate;

a tapered reflective surface, protruding from a middle portion of a surface at one side of the reflective member main plate and comprising a large open end and a small open end, the large open end being arranged in a middle of the reflective plate main plate; and a reflective member through hole penetrating through the reflective member main plate;

wherein the short distance light source is a COB lamp plate mounted to the reflective member main plate and arranged around the large open end of the tapered reflective surface, and wires for electrical connecting pass through the reflective member through hole;

wherein the lamp head portion comprises a lamp bead base fixedly connected to the reflective member; and the lamp bead base comprises a lamp bead base partition plate provided with at least one partition plate through hole; wherein the lamp bead base further comprises a second hollow cavity of the lamp bead base which is provided at a side of the lamp bead base partition plate opposite to a side of the lamp bead base partition plate facing a reflector;

wherein the long distance light source is an LED lamp plate on which at least one LED lamp bead is provided; the LED lamp plate is mounted into a first hollow cavity of the lamp bead base or into a lamp bead mounting slot a position of the LED lamp bead corresponds to that of the small open end of the tapered reflective surface; a spacer is provided between the small open end of the tapered reflective surface and the LED lamp plate; the spacer is provided with a spacer light hole and a spacer through hole; a position of the spacer light hole corresponds to that of the LED lamp bead; wherein wires pass through the spacer from the spacer through hole;

wherein the lamp head portion comprises:

a lamp head inner casing comprising opposing an inner casing light exit port and an inner casing opening;

a light transmitting member, mounted to the inner casing light exit port;

a first sealing member, arranged at a joint of the inner casing light exit port and the light transmitting member;

an outer casing light exit port corresponding to the inner casing light exit port; and an outer casing opening, sheathing the lamp head inner casing, opposing the outer casing light exit port;

wherein the lamp head portion comprises a lamp head base mounted to an inner casing opening of the lamp head inner casing; the lamp head base is provided with a lamp head base hollow cavity in the middle, one part of the lamp bead base is inserted to the lamp head base hollow cavity; and a second sealing member, arranged at a joint between the lamp head base and the inner casing opening;

wherein the first sealing member and the second sealing member are configured to prevent external water from entering the lighting equipment.

2. The lighting equipment according to claim 1, wherein the reflective member further comprises:

a heat fin protruding from an outside wall of the tapered reflective surface; and/or a heat sink protruding from a surface of the reflective member main plate; and a heat dissipation channel enclosed by the heat fin and/or the heat sink, and communicated with the reflective member through hole;

wherein the reflective member is made of a metal material.

3. The lighting equipment according to claim 1, wherein the COB lamp plate comprises a COB substrate; and one COB chip which is annular and is fitted onto the COB substrate; or, more than two COB chips, which are strip-shaped, forming an annular shape and mounted onto the COB substrate.

4. The lighting equipment according to claim 1, wherein the lamp bead base further comprises the first hollow cavity of the lamp bead base;

the first hollow cavity of the lamp bead base and the second hollow cavity of the lamp bead base are provided at two sides of the lamp bead base partition plate respectively;

one part of the reflective member is inserted to the first hollow cavity of the lamp bead base.

5. The lighting equipment according to claim 1, wherein the lamp head portion comprises a light source circuit board which is provided with a switch control circuit, the short distance light source and the long distance light source are electrically connected to the power supply through the switch control circuit;

the switch control circuit comprises a touch switch and a controller;

the controller controls the light and shade state of the short distance light source and/or the long distance light source according to the number of times of on and off of the touch switch.

6. The lighting equipment according to claim 1, wherein the lamp head portion comprises a first conductive member fixing base, arranged in the lamp head base hollow cavity; comprising a first fixing base body, provided with a first fixing base through hole in the middle; and a first connecting pipe, connected to the lamp bead base; the first fixing base body and the first connecting pipe are integrated;

a first conductive member, one end of which passes through the first fixing base through hole and is electrically connected to a first contact of a battery holder; another end thereof is provided with a first conductive member recess; and a first spring, one end of which is provided inside the first conductive member recess, and another end thereof is electrically connected to one conductor slice of the light source circuit board.

7. The lighting equipment according to claim 1, wherein the lamp head portion comprises a second conductive member fixing base, arranged inside the lamp head base hollow cavity, comprising a second fixing plate, provided with a second fixing plate through hole in the middle, and is fixedly connected to a battery holder; and a second connecting pipe, protruding from a surface of the second fixing base plate, a position of which corresponds to that of the second fixing plate through hole;

a second conductive member gasket, arranged between the second fixing plate and the light source circuit board; and a second conductive member, one end of which is electrically connected to one conductor slice of the light source circuit board, and another end thereof passes through the second connecting pipe and the second conductive member gasket and is electrically connected to the power supply, the second fixing plate and the second connecting pipe are integrated.

8. The lighting equipment according to claim 1, wherein the connecting portion comprises a tube body, one end of which is connected to the lamp head base, and another end is connected to a tail hood inner casing;

a third sealing member, arranged at a joint between the tube body and the lamp head base;

a battery holder, arranged inside the tube body, whose two ends are provided with a first contact and a second contact; and at least one battery, arranged inside the battery holder; when the number of batteries is more than two, the batteries are connected in series with each other.

9. The lighting equipment according to claim 8, wherein the tail portion comprises a tail hood inner casing, one end of which is inserted to the tube body, another end of which is provided with an inner casing switch through hole; and a fourth sealing member, arranged at a joint between the tail hood inner casing and the tube body.

10. The lighting equipment according to claim 9, wherein the tail portion comprises a tail hood outer casing, one end of which sheathes the tail hood inner casing, and another end of which is provided with an outer casing switch through hole.

11. The lighting equipment according to claim 9, wherein the tail hood inner casing is provided therein with a push switch, comprising a pressing end and two pins;

a switch circuit board, comprising two insulated conductor slices which are electrically connected to the two pins of the push switch respectively; and a tail hood conductive member, one end of which is electrically connected to a second contact of the battery holder, and another end of which is electrically connected to the switch circuit board.

* * * * *